US008370135B2

(12) United States Patent
Shlomot et al.

(10) Patent No.: US 8,370,135 B2
(45) **Date of Patent: *Feb. 5, 2013**

(54) METHOD AND APPARATUS FOR ENCODING AND DECODING

(75) Inventors: Eyal Shlomot, Long Beach, CA (US); Libin Zhang, Shenzhen (CN); Jinliang Dai, Shenzhen (CN)

(73) Assignee: Huawei Technologies Co., Ltd, Shenzhen (CN)

( * ) Notice: Subject to any disclaimer, the term of this patent is extended or adjusted under 35 U.S.C. 154(b) by 234 days.

This patent is subject to a terminal disclaimer.

(21) Appl. No.: 12/820,805

(22) Filed: Jun. 22, 2010

(65) Prior Publication Data

US 2010/0280823 A1 Nov. 4, 2010

Related U.S. Application Data

(63) Continuation of application No. PCT/CN2009/071030, filed on Mar. 26, 2009.

(30) Foreign Application Priority Data

Mar. 26, 2008 (CN) ..... 2008 1 0084077

(51) Int. Cl.
*G10L 21/02* (2006.01)

(52) U.S. Cl. ..... 704/226; 704/219

(58) Field of Classification Search ..... 704/208, 704/210, 214, 215–219, 226
See application file for complete search history.

(56) References Cited

U.S. PATENT DOCUMENTS 5,189,669 A 2/1993 Nunokawa
5,559,832 A 9/1996 Laird
5,577,087 A 11/1996 Furuya
5,694,429 A 12/1997 Sekine et al.
5,742,734 A 4/1998 DeJaco et al.
5,774,849 A * 6/1998 Benyassine et al. ..... 704/246
6,424,942 B1 * 7/2002 Mustel et al. ..... 704/233
6,606,593 B1 8/2003 Jarvinen et al.
6,711,537 B1 3/2004 Beaucoup (Continued)

FOREIGN PATENT DOCUMENTS

CN 1512487 A 7/2004
CN 1513168 A 7/2004

(Continued)

OTHER PUBLICATIONS

"3rd Generation Partnership Project; Technical Specification Group Services and System Aspects; Mandatory Speech Codec speech processing functions; AMR Speech Codec; Comfort noise aspect (Release 4)," 3GPP TS 26.092 V4.0.0 (Mar. 2001), 12 pages.

(Continued)

*Primary Examiner* — Abul Azad
(74) *Attorney, Agent, or Firm* — Slater & Matsil, L.L.P.

(57) ABSTRACT

An encoding method includes extracting background noise characteristic parameters within a hangover period, for a first superframe after the hangover period, performing background noise encoding based on the extracted background noise characteristic parameters, for superframes after the first superframe, performing background noise characteristic parameter extraction and DTX decision for each frame in the superframes after the first superframe, and for the superframes after the first superframe, performing background noise encoding based on extracted background noise characteristic parameters of the current superframe, background noise characteristic parameters of a plurality of superframes previous to the current superframe, and a final DTX decision. Also, a decoding method and apparatus and an encoding apparatus are disclosed. Bandwidth occupancy may be reduced substantially while the signal quality may be guaranteed.

24 Claims, 10 Drawing Sheets

U.S. PATENT DOCUMENTS

| | | | | |
|---|---|---|---|---|
| 7,092,875 | B2 | 8/2006 | Tsuchinaga et al. | |
| 7,099,387 | B2 | 8/2006 | Bjontegaard et al. | |
| 7,912,712 | B2 * | 3/2011 | Shlomot et al. | 704/226 |
| 2001/0008995 | A1 | 7/2001 | Kim et al. | |
| 2001/0046843 | A1 | 11/2001 | Alanara et al. | |
| 2002/0188445 | A1 | 12/2002 | Li | |
| 2003/0202601 | A1 | 10/2003 | Bjontegaard et al. | |
| 2005/0027520 | A1 | 2/2005 | Mattila et al. | |
| 2005/0137864 | A1 * | 6/2005 | Valve et al. | 704/227 |
| 2006/0293885 | A1 | 12/2006 | Gournay et al. | |
| 2007/0041449 | A1 | 2/2007 | Bjontegaard et al. | |
| 2008/0027717 | A1 | 1/2008 | Rajendran et al. | |
| 2008/0049785 | A1 | 2/2008 | Lakaniemi | |
| 2008/0195383 | A1 | 8/2008 | Shlomot et al. | |
| 2010/0088092 | A1 * | 4/2010 | Bruhn | 704/228 |
| 2011/0046843 | A1 | 2/2011 | Caveney | |

FOREIGN PATENT DOCUMENTS

| | | | |
|---|---|---|---|
| CN | 1656817 | A | 8/2005 |
| CN | 101335000 | A | 12/2008 |
| CN | 101335000 | B | 4/2010 |
| EP | 1 265 224 | A1 | 12/2002 |
| EP | 1 265 244 | A1 | 12/2002 |
| EP | 0 785 541 | B1 | 4/2003 |
| EP | 0 843 301 | B1 | 9/2003 |
| EP | 1 337 999 | B1 | 8/2006 |
| EP | 1 288 913 | B1 | 2/2007 |
| JP | 3-88517 | | 4/1991 |
| JP | 2595372 | B2 | 4/1997 |
| JP | 3090842 | B2 | 9/2000 |
| KR | 20010073377 | A | 8/2001 |
| WO | WO 02/43048 | A2 | 5/2002 |
| WO | WO 2008/100385 | A2 | 8/2008 |

OTHER PUBLICATIONS

"Series G: Transmission Systems and Media, Digital Systems and Networks, Digital terminal equipments—Coding of analogue signals by methods other than PCM," ITU-T Telecommunication Standardization Sector of ITU, G.729.1, Amendment 4: New Annex C (DTX/CNG scheme) plus corrections to main body and Annex B, (Jun. 2008), 128 pages.

Chuan-Bin, J., et al., "A New Wideband Speech CODEC AMR—WB," 2005, China Academic Journal Electronic Publishing House, 4 pages. English abstract on p. 1.

Xin, M., Research and Realization of the DTXCNG Algorithm Based on Scalable Wideband Speech Coder Decoder System, English Translation of Masteral Dissertation, Dalian University of Technology, Answer date of masteral disseration Dec. 14, 2007, Chapter 4.1, 5 pages.

International Telecommunication Union, ITU-T, Telecommunication Standardization Sector of ITU, Series G: Transmission Systems and Media; Digital transmission systems—Terminal equipments—Coding of analogue signals by methods other than PCM; G.729 Annex B (Nov. 1996), 23 pages.

International Search Report, International application No. PCT/CN2009/071030, Date of mailing of the international search report Jul. 9, 2009, 10 pages.

Written Opinion of the International Searching Authority, International Application No. PCT/CN2009/071030, Applicant: Huawei Technologies Co., Ltd., et al., Date of mailing: Jul. 24, 2009, 13 pages.

Supplementary European Search Report, European Application No. 09726234.9-2225, Applicant: Huawei Technologies Co., Ltd., Dated: Dec. 15, 2010, 5 pages.

Benyassine, A., et al., "ITU-T Recommendation G.729 Annex B: A Silence Compression Scheme for Use with G.729 Optimized for V.70 Digital Simultaneous Voice and Data Applications," IEEE Communications Magazine, Sep. 1997, pp. 64-73, IEEE.

ITU-T, "Series G: Transmission Systems and Media, Digital Systems and Networks; Digital terminal equipments—Coding of analogue signals by methods other than PCM; G.729 based Embedded Variable bit-rate coder: An 8-32 kbit/s scalable wideband coder bitstream interoperable with G.729," G.729.1 (May 2006), 97 pages.

"3rd Generation Partnership Project; Technical Specification Group Services and System Aspects; Mandatory speech codec speech processing functions Adaptive Multi-Rate (AMR) speech codec; Source controlled rate operation (Release 6)," 3GPP TS 26.093 V6.1.0 (Jun. 2006), 29 pages.

* cited by examiner

METHOD AND APPARATUS FOR ENCODING AND DECODING

This application is a continuation of co-pending International Application No. PCT/CN2009/071030, filed Mar. 26, 2009, which designated the United States and was not published in English, and which claims priority to Chinese Application No. 200810084077.6, filed Mar. 26, 2008, both of which applications are incorporated herein by reference.

CROSS-REFERENCE TO RELATED APPLICATIONS

This application relates to the following commonly assigned patent application: Ser. No. 12,881,926, filed Sep. 14, 2010 entitled "Method and Apparatus for Encoding and Decoding," and now U.S. Pat. No. 7,912,712, which application is hereby incorporated herein by reference.

TECHNICAL FIELD

The disclosure relates to the technical field of communications, and more particularly, to a method and apparatus for encoding and decoding.

BACKGROUND

In speech communications, encoding and decoding of the background noise are performed according to a noise processing scheme defined in G.729B released by the International Telecom Union (ITU).

A silence compression technology is introduced into a speech encoder, and FIG. 1 shows the schematic diagram of the signal processing.

The silence compression technology mainly includes three modules: Voice Activity Detection (VAD), Discontinuous Transmission (DTX), and Comfort Noise Generator (CNG). VAD and DTX are modules included in the encoder, and CNG is a module included in the decoding side. FIG. 1 is a schematic diagram showing the principle components of a silence compression system, and the basic processes are as follows.

First, at the transmitting side (i.e., the encoding side), for each input signal frame, the VAD module analyzes and detects the current input signal frame, and detects whether a speech signal is contained in the current signal frame. If a speech signal is contained in the current signal frame, the current frame is marked as a speech frame. Otherwise, the current frame is set as a non-speech frame.

Then, the encoder encodes the current signal based on a VAD detection result. If the VAD detection result indicates a speech frame, the signal is input to a speech encoder for speech encoding and a speech frame is output. If the VAD detection result indicates a non-speech frame, the signal is input to the DTX module where a non-speech encoder is used for performing background noise processing and outputs a non-speech frame.

Finally, the received signal frame (including speech frames and non-speech frames) is decoded at the receiving side (the decoding side). If the received signal frame is a speech frame, it is decoded by a speech decoder. Otherwise, it is input to a CNG module, which decodes the background noise based on parameters transmitted in the non-speech frame. A comfort background noise or silence is generated so that the decoded signal sounds more natural and continuous.

By introducing such a variable bit-rate encoding scheme to the encoder and performing a suitable encoding on the signal of the silence phase, the silence compression technology effectively solves the problem that the background noise may be discontinuous and improves the quality of synthesized signal. Therefore, the background noise at the decoding side may also be referred to as comfort noise. Furthermore, the background noise encoding rate is much lower than the speech encoding rate, and thus the average encoding rate of the system is reduced substantially so that the bandwidth may be saved effectively.

In G.729B, signal processing is performed on a frame-by-frame basis. The length of a frame is 10 ms. To save bandwidth, G.729.1 further defines the silence compression system requirements. It is required that in the presence of the background noise, the system should encode and transmit the background noise at low bit-rate without reducing the overall signal encoding quality. In other words, DTX and CNG requirements are defined. More importantly, it is required that the DTX/CNG system should be compatible with G.729B. Although a G.729B based DTX/CNG system may be transplanted simply into a G.729.1 based system, two problems remain to be settled. First, the two encoders will process frames of different lengths, and thus direct transplantation may be problematic. Moreover, the 729B based DTX/CNG system is relatively simple, especially the parameter extraction part. To meet the requirements of DTX/CNG in G.729.1, the 729B based DTX/CNG system should be extended. Second, the G.729.1 based system can processes wideband signals but the G.729B based system can only process Lower-band signals. A scheme for processing the Higher-band components of the background noise signal (4000 Hz~7000 Hz) should thus be added to the G.729.1 based DTX/CNG system so as to form a complete system.

The prior art at least has problems as follows. The existing G.729B based systems can only process Lower-band background noise, and accordingly the signal encoding quality cannot be guaranteed when being transplanted into the G.729.1 based systems.

SUMMARY OF THE INVENTION

In view of the above, embodiments of the invention provide a method and apparatus for encoding and decoding, which are extended from G.729B, that can meet the requirements of the G.729.1 technical standard, and the signal communication bandwidth may be reduced substantially while the signal encoding quality may be guaranteed.

To solve the above problem, an embodiment of the invention provides an encoding method including extracting background noise characteristic parameters within a hangover period, for the first superframe after the hangover period, performing background noise encoding based on the extracted background noise characteristic parameters within the hangover period and background noise characteristic parameters of the first superframe, for superframes after the first superframe, performing background noise characteristic parameter extraction and DTX decision for each frame in the superframes after the first superframe, and for the superframes after the first superframe, performing background noise encoding based on the extracted background noise characteristic parameters of the current superframe, background noise characteristic parameters of a plurality of superframes previous to the current superframe, and the final DTX decision.

Also, a decoding method is provided including obtaining CNG parameters of a first frame of a first superframe from a speech encoding frame previous to the first frame of the first superframe, and performing background noise decoding for the first frame of the first superframe based on the CNG parameters. The CNG parameters include a target excited gain, which is determined by a long-term smoothed fixed codebook gain which is smoothed from the fixed codebook gain of the speech encoding frames, and an LPC filter coefficient, which is defined by a long-term smoothed LPC filter coefficient which is smoothed from the LPC filter coefficient of the speech encoding frames.

Also, an encoding apparatus is provided including a first extracting unit configured to extract background noise characteristic parameters within a hangover period, a second encoding unit configured to, for the first superframe after the hangover period, perform background noise encoding based on the extracted background noise characteristic parameters within the hangover period and background noise characteristic parameters of the first superframe, a second extracting unit, configured to, for superframes after the first superframe, perform background noise characteristic parameter extraction for each frame, a DTX decision unit, configured to: for superframes after the first superframe, perform DTX decision for each frame; and, a third encoding unit, configured to, for superframes after the first superframe, perform background noise encoding based on the extracted background noise characteristic parameters of the current superframe, background noise characteristic parameters of a plurality of superframes previous to the current superframe, and the final DTX decision.

Also, a decoding apparatus is provided including a CNG parameter obtaining unit, configured to obtain CNG parameters of a first frame in a first superframe from a speech encoding frame previous to the first frame in the first superframe, and a first decoding unit, configured to perform background noise decoding for the first frame of the first superframe based on the CNG parameters. The CNG parameters include a target excited gain, which is determined by a long-term smoothed fixed codebook gain which is smoothed from the fixed codebook gain of the speech encoding frames, and an LPC filter coefficient, which is defined by a long-term smoothed LPC filter coefficient which is smoothed from the LPC filter coefficient of the speech encoding frames.

According to embodiments of the invention, background noise characteristic parameters are extracted within a hangover period. For the first superframe after the hangover period, background noise encoding is performed based on the extracted background noise characteristic parameters within the hangover period and background noise characteristic parameters of the first superframe. For superframes after the first superframe, background noise characteristic parameters extraction and DTX decision are performed for each frame in superframes after the first superframe. For the superframes after the first superframe, background noise encoding is performed based on the extracted background noise characteristic parameters of the current superframe, background noise characteristic parameters of a plurality of superframes previous to the current superframe, and the final DTX decision. Advantages may be achieved as follows.

First, the signal communication bandwidth may be reduced substantially while the encoding quality may be guaranteed.

Second, the requirements of the G.729.1 system specification may be satisfied by extending the G.729B system.

Third, the background noise may be encoded more accurately by a flexible and precise extraction of the background noise characteristic parameters.

DETAILED DESCRIPTION OF ILLUSTRATIVE EMBODIMENTS

Figure 1:
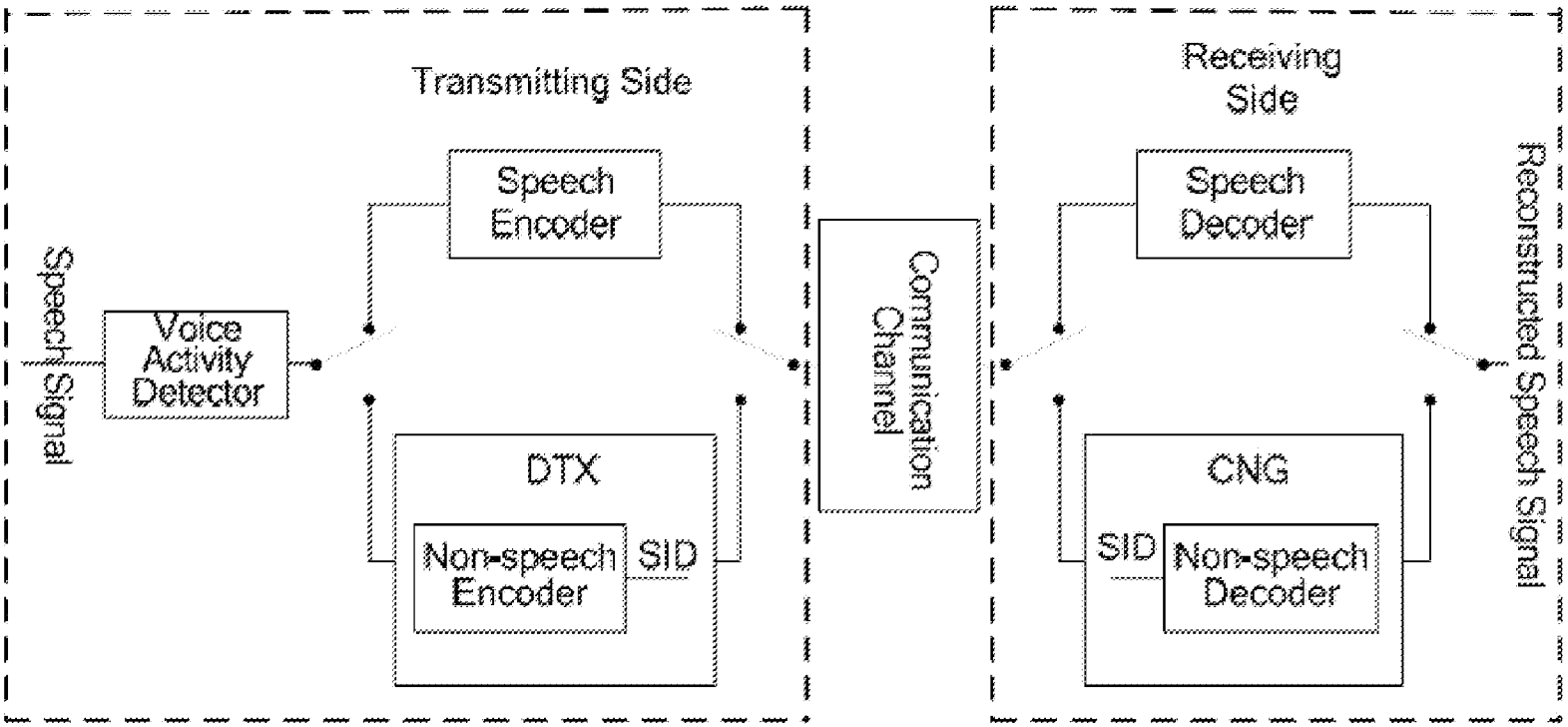
FIG. 1 (Prior Art)
FIG. 1 is a schematic diagram of a silence compression system.

Further detailed descriptions will be made below to the implementations of the invention with reference to the accompanying drawings.

First, an introduction will be made to the related principles of the G.729B standards based system.

1.1.2. Similarity and Difference Between the Encoding Parameters of a Speech Code Stream and a Background Noise Code Stream.

In the current speech encoder, the synthesizing principle of the background noise is the same as the synthesizing principle of the speech. In both cases, a Code Excited Linear Prediction (CELP) model is employed. The synthesizing principle of the speech is as follows. A speech s(n) may be considered as the output resulting from exciting a synthesis filter v(n) with an excitation signal e(n). That is, $s(n)=e(n)*v(n)$. This is the mathematical model for speech synthesis. This model is also used for synthesizing the background noise. Thus, the characteristic parameters describing the characteristics of the background noise and the silence transmitted in the background noise code stream are substantially the same as the characteristic parameters in the speech code stream, i.e., the synthesis filter parameters and the excitation parameters used in signal synthesis.

In the speech code stream, the synthesis filter parameter(s) mainly refers to the LSF quantization parameter(s), and the excitation signal parameter(s) may include an adaptive-codebook delay, an adaptive-codebook gain, a fixed codebook parameter, and a fixed codebook gain parameter. Depending on different speech encoders, these parameters may have different numbers of quantized bits and different types of quantization. For the same encoder, if several rates are contained, the encoding parameters still may have different numbers of quantized bits and different types of quantization under different rates because the signal characteristics may be described in different aspects and features.

Different from the speech encoding parameter(s), the background noise encoding parameter(s) describes the characteristics of the background noise. The excitation signal of the background noise may be considered as a simple random noise sequence. These sequences may be generated simply at the random noise generation module of the encoding and decoding sides. Then, the amplitudes of these sequences may be controlled by the energy parameter, and a final excitation signal may be generated. Thus, the characteristic parameters of the excitation signal may simply be represented by the energy parameter, without further description from some other characteristic parameters. Therefore, in the background noise code stream, its excitation parameter is the energy parameter of the current background noise frame, which is different from the speech frame. Same as the speech frame, the synthesis filter parameter(s) in the background noise code stream is the LSF quantization parameter(s), but the specific quantization method may be different. In view of the above analysis, the scheme for encoding the background noise may be considered in nature as a simple scheme for encoding "the speech".

The noise processing scheme in G.729B (refer to the 729B protocol).

1.2.1 DTX/CNG Technical Overview.

The silence compression scheme in G.729B is an early silence compression technology, and the algorithm model of its background noise encoding and decoding technology is CELP. Therefore, the transmitted background noise parameters are also extracted based on the CELP model, including a synthesis filter parameter(s) and an excitation parameter(s) describing the background noise. The excitation parameter(s) are the energy parameter(s) used to describe the background noise energy. There are no adaptive and fixed codebook parameters used to describe the speech excitation. The filter parameter and the speech encoding parameter are basically consistent, being the LSF parameter. At the encoding side, for each frame of input speech signals, if the VAD decision is "0" indicating that the current signal is the background noise, the encoder feeds the signal into the DTX module. The DTX module extracts the background noise parameters from the input signals, and then encodes the background noise based on the change in the parameters of each frame. If the filter parameter and the energy parameter extracted from the current frame have a big change as compared to several previous frames, it indicates that the current background noise characteristics are largely different from the previous background noise characteristics. Then, the noise encoding module encodes the background noise parameters extracted from the current frame, and assembles them into a Silence Insertion Descriptor (SID) frame. The SID frame is transmitted to the decoding side. Otherwise, a NODATA frame (without data) is transmitted to the decoding side. Both the SID frame and the NODATA frame may be referred to as non-speech frame. At the decoding side, upon entry into the background noise phase, the CNG module may synthesize comfort noise describing the encoding side background noise characteristics based on the received non-speech frame.

In G.729B, signal processing is performed on a frame-by-frame basis. The length of a frame is 10 ms. The DTX, noise encoding, and CNG modules of 729B will be described in the following three sections.

1.2.2 The DTX Module.

The DTX module is mainly configured to estimate and quantize the background noise parameter, and transmit SID frames. In the non-speech phase, the DTX module transmits the background noise information to the decoding side. The background noise information is encapsulated in an SID frame for transmission. If the current background noise is not stable, an SID frame is transmitted. Otherwise, a NODATA frame containing no data is transmitted. Additionally, the interval between two consecutive SID frames may be limited to two frames. If the background noise is not stable, SID frames should be transmitted continuously, and thus the transmission of the next SID frame will have a delay.

At the encoding side, the DTX module receives the output of the VAD module in the encoder, the autocorrelation coefficient, and some previous excitation samples. At each frame, the DTX module describes the non-transmit frame, the speech frame, and the SID frame with 0, 1, and 2 respectively. The frame types are Ftyp=0, Ftyp=1, and Ftyp=2.

The objects of Background noise estimation include the energy level and the spectral envelope of the background noise, which is substantially similar to the speech encoding parameter. Thus, calculation of the spectral envelope is substantially similar to calculation of the speech encoding parameter, which uses the parameters from two previous frames. The energy parameter is an average of the energies of several previous frames.

Main Operations of the DTX Module.

a. Storage of the Autocorrelation Coefficients of Each Frame.

For each input signal frame, i.e., either a speech frame or a non-speech frame, the autocorrelation coefficients of the current frame t may be retained in a buffer. These autocorrelation coefficients are denoted by $r'_t(j)$, j=0 . . . 10, where j is the index of an autocorrelation function for each frame.

b. Estimate of the Current Frame Type.

If the current frame is a speech frame, i.e., VAD=1, the current frame type is set to 1. If the current frame is a non-speech frame, a current LPC filter $A_t(z)$ may be calculated based on the autocorrelation coefficients of the previous frame(s) and the present frame. Before calculation of $A_t(z)$, the average of the autocorrelation coefficients of two consecutive frames may be calculated first:

$$R^t(j) = \sum_{i=t-N_{cur}+1}^{t} r'_i(j), \quad j = 0 \ldots 10$$

where $N_{cur}$=2. After calculation of $R^t(j)$, a Levinson-Durbin algorithm may be used to calculate $A_t(z)$. Also, the Levinson-Durbin algorithm may be used to calculate the residual energy $E_t$, which may be taken as a simple estimate of the excitation energy of the frame.

The type of the current frame may be estimated as follows.

(1) If the current frame is the first inactive frame, the frame is set as an SID frame. Let a variable $\overline{E}$ characterizing the signal energy be equal to $E_t$ and the parameter $k_E$ characterizing the number of frames be set to 1:

$$(Vad_{t-1} = 1) \Rightarrow \begin{cases} Ftyp = 2 \\ \overline{E} = E_t \\ k_E = 1 \end{cases}$$

(2) For other non-speech frames, the algorithm compares the parameter of the previous SID frame with the current corresponding parameter. If the current filter is largely different from the previous filter or the current excitation energy is largely different from the previous excitation energy, let the flag flag_change be equal to 1. Otherwise, the value of the flag remains unchanged.

(3) The current counter count_fr indicates the number of frames between the current frame and the previous SID. If this value is larger than $N_{min}$, an SID frame is transmitted. If flag_change is equal to 1, an SID frame is transmitted too. In other cases, the current frame is not transmitted.

$$\left.\begin{array}{l} \text{count_fr} \geq N_{min} \\ \text{flag_chang} = 1 \end{array}\right\} \Rightarrow Ftyp_t = 2$$

$$\text{Otherwise: } Ftyp_t = 0$$

In case of an SID frame, the counter count_fr and the flag flag_change are reinitialized to 0.

c. LPC Filter Coefficients.

Let the coefficients of the LPC filter $A_{sid}(z)$ of the previous SID be $a_{sid}(j)$, j=0 . . . 10. If the Itakura distance between the SID-LPC filters of current frame and the previous frame exceeds a given threshold, they may be considered as largely different.

$$\sum_{j=0}^{10} R_a(i) \times R^t(i) \geq E_t \times thr1$$

where $R_a(j)$, j=0 . . . 10 are the autocorrelation coefficients of the SID filter coefficients:

$$\begin{cases} R_a(j) = 2\sum_{k=0}^{10-j} a_{sid}(k) \times a_{sid}(k+j) \text{ if } (j \neq 0) \\ R_a(0) = \sum_{k=0}^{10} a_{sid}(k)^2 \end{cases}$$

d. Frame Energy.

The sum of the frame energies may be calculated as:

$$\overline{E} = \sum_{i=t-k_E+1}^{t} E_i$$

Then, $\overline{E}$ is quantized with a 5-bit quantizer in the logarithmic domain. The decoded logarithmic energy $E_q$ is compared to the previous decoded SID logarithmic energy $E_q^{sid}$. If they are different by more than 2 dB, they may be considered to have largely different energies.

1.2.3 Noise Encoding and SID Frame.

The parameters in the SID frame are the LPC filter coefficient (spectral envelope) and the energy quantization parameter.

In calculating the SID-LPC filter, the stability between consecutive noise frames is taken into account.

First, the average LPC filter $\overline{A}_p(z)$ for $N_p$ frames previous to the current SID frame is calculated. The autocorrelation function and $\overline{R}_p(j)$ are used. Then, $\overline{R}_p(j)$ is input into the Levinson-Durbin algorithm, so as to obtain $\overline{A}_p(z)$. $\overline{R}_p(j)$ may be represented as:

$$\overline{R}_p(j) = \sum_{k=t'-N_p}^{t'} (r')_k(j), \quad j = 0 \ldots 10$$

where the value of $N_p$ is fixed at 6. The number of frames t' has a range [t−1, t−$N_{cur}$]. Thus, the SID-LPC filter may be represented as:

$$A_{sid}(z) = \begin{cases} A_t(z) & \text{if distance}(A_t(z), \overline{A}_p(z)) \geq thr3 \\ \overline{A}_p(z) & \text{otherwise} \end{cases}$$

In other words, the algorithm will calculate the average LPC filter coefficient $\overline{A}_p(z)$ of several previous frames, and then compare it with the current LPC filter coefficient $A_t(z)$. If they have a slight difference, the average $\overline{A}_p(z)$ of several previous frames will be selected for the current frame when the LPC coefficient is quantized. Otherwise, $A_t(z)$ of the current frame will be selected. After selection of the LPC filter coefficients, the algorithm may transform these LPC filter coefficients to the LSF domain, and then quantization encoding is performed. The selection manner for the quantization encoding may be the same as the quantization encoding manner for the speech encoding.

The energy parameter(s) is quantized with a 5-bit linear quantizer in the logarithmic domain. In this way, background noise encoding has been completed. Then, these encoded bits are encapsulated in an SID frame, as shown in Table A.

TABLE A

TABLE B.2/G.729

| Parameter description | Bits |
|---|---|
| Switched predictor index of LSF quantizer | 1 |
| First stage vector of LSF quantizer | 5 |
| Second stage vector of LSF quantizer | 4 |
| Gain (Energy) | 5 |

The parameters in an SID frame are composed of four codebook indexes, one of which indicates the energy quantization index (5 bits). The three remaining ones may indicate the spectral quantization index (10 bits).

1.2.4 The CNG Module.

At the decoding side, the algorithm uses a level controllable pseudo white noise to excite an interpolated LPC synthesis filter so as to obtain comfort background noise, which is substantially similar to speech synthesis. Here, the excitation level and the LPC filter coefficient are obtained from the previous SID frame respectively. The LPC filter coefficient of a subframe may be obtained by interpolation of the LSP parameter in the SID frame. The interpolation method is similar to the interpolation scheme in the speech encoder.

The pseudo white noise excitation ex(n) is a mix of the speech excitation ex1($n$) and a Gaussian white noise excitation ex2($n$). The gain for ex1($n$) is relatively small. The purpose of using ex1($n$) is to make the transition between speech and non-speech more natural.

Thus, after the excitation signal is obtained, it may be used to excite the synthesis filter so as to obtain comfort background noise.

Since the non-speech encoding and decoding at the encoding and decoding sides should maintain synchronization, both sides will generate excitation signals for the SID frame and non-transmit frame.

First, a target excited gain $\tilde{G}_t$ is defined, which is taken as the square root of the excited average energies of the current frame. $\tilde{G}_t$ may be obtained with the following smoothing algorithm, where $\tilde{G}_{sid}$ is the gain for the decoded SID frame:

$$\tilde{G}_t = \begin{cases} \tilde{G}_{sid} & \text{if } (Vad_{t-1} = 1) \\ \frac{7}{8}\tilde{G}_{t-1} + \frac{1}{8}\tilde{G}_{sid} & \text{otherwise} \end{cases}$$

Eighty samples are divided into two subframes. For each subframe, the excitation signal of the CNG module may be synthesized as follows.

(1) A pitch delay is selected randomly from the range [40,103].

(2) The positions and symbols of the non-zero pulses may be selected randomly from the fixed codebook vector of the subframe (the positions and symbol structure of these non-zero pulses are compatible with G.729).

(3) An adaptive codebook excited signal with gain is selected and labeled as $e_a(n)$, n=0 . . . 39. The selected fixed codebook excitation signal may be labeled as $e_f(n)$, n=0 . . . 39. Then, based on the subframe energy, the adaptive gain $G_a$ and fixed codebook gain $G_f$ may be calculated as:

$$\frac{1}{40}\sum_{n=0}^{39}(G_a \times e_a(n) + G_f \times e_f(n))^2 = \tilde{G}_t^2$$

It is to be noted that $G_f$ may select a negative value.

Definition is made as follows:

$$E_a = \left(\sum_{n=0}^{39} e_a(n)^2\right), \quad I = \left(\sum_{n=0}^{119} e_a(n)e_f(n)\right), \quad K = 40 \times \tilde{G}_t^2$$

From the excitation structure of the ACELP, we get:

$$\sum_{n=0}^{39} e_f(n)^2 = 4.$$

If the adaptive-codebook gain $G_a$ is fixed, the algorithm characterizing $\tilde{G}_t$ becomes a second order algorithm with respect to $G_f$:

$$G_f^2 + \frac{G_a \times I}{2} G_f + \frac{E_a \times G_a^2 - K}{4} = 0$$

The value of $G_a$ will be limited so that the above algorithm has a solution. Further, the application of some large adaptive codebook gains may be limited. In this manner, the adaptive codebook gain $G_a$ may be selected randomly in the following range:

$$\left[0, \ \text{Max}\left\{0.5, \ \sqrt{\frac{K}{A}}\right\}\right], \quad \text{with } A = E_a - I^2/4$$

A root having the minimum absolute value among the roots of the algorithm $$\frac{1}{40}\sum_{n=0}^{39}(G_a \times e_a(n) + G_f \times e_f(n))^2 = \tilde{G}_t^2$$

is taken as the value of $G_f$.

Finally, the G.729 excitation signal may be constructed as follows:

$$ex_1(n) = G_a \times e_a(n) + G_f \times e_f[n], \ n = 0 \ldots 39$$

The synthesized excitation ex(n) may be synthesized with the following method.

Let $E_1$ be the energy of $ex_1(n)$, $E_2$ be the energy of $ex_2(n)$, and $E_3$ be the multiplication of $ex_1(n)$ and $ex_2(n)$:

$$E_1 = \Sigma ex_1^2(n)$$

$$E_2 = \Sigma ex_2^2(n)$$

$$E_3 = \Sigma ex_1(n) \cdot ex_2(n)$$

The point number of the calculation exceeds its own size.

Let α and β be the scaling coefficients of $ex_1(n)$ and $ex_2(n)$ in the mixed excitation, where α is set to 0.6 and β is determined by the following quadratic algorithm:

$$\beta^2 E_2 + 2\alpha\beta E_3 + (\alpha^2 - 1)E_1 = 0, \text{ with } \beta > 0$$

If there is no solution for β, β will be set to 0 and α will be set to 1. The final excitation of the CNG module becomes ex(n):

$$ex(n) = \alpha ex_1(n) + \beta ex_2(n)$$

The basic principles of the DTX/CNG module in the 729.B encoder have been described above.

1.3 The Basic Flow of the G.729.1 Encoder and Decoder.

G.729.1 is a new-generation speech encoding and decoding standard newly released by the ITU (see Reference HD. It is an extension to ITU-TG.729 over the 8-32 kbps scalable wideband (50-7000 Hz). By default, the sampling rates at the encoder input and the decoder output are 16000 Hz. A code stream generated by the encoder is layered, containing 12 embedded layers, referred to as layers 1~12 respectively. Layer 1 is the core layer, corresponding to a bit rate of 8 kbps. This layer is compatible with the G.729 code stream so that G.729EV is interoperable with G.729. Layer 2 is a Lower-band enhancement layer and 4 kbps is increased. Layers 3-12 are broadband enhancement layers and totally 20 kbps may be increased, 2 kbps per layer.

The G.729.1 encoder and decoder are based on a three-stage structure: embedded Code-Excited Linear-Prediction (CELP) encoding and decoding, Time-Domain BandWidth Extension (TDBWE), and estimate transformation encoding and decoding known as Time-domain Alias Cancellation (TDAC). During the embedded CELP phase, layer 1 and layer 2 are generated, so as to generate the 8 kbps and 12 kbps Lower-band synthesis signals (50-4000 Hz). The TDBWE stage generates layer 3 and a 14 kbps broadband output signal is produced (50-7000 Hz). The TDAC stage operates in the Modified Discrete Cosine Transform (MDCT) domain, and layers 4~12 are generated. Thus, the signal quality increases from 14 kbps to 32 kbps. The TDAC encoding and decoding may represent 50-4000 Hz band weighted CELP encoding and decoding error signal and 4000-7000 Hz band input signal.

Figure 2A:
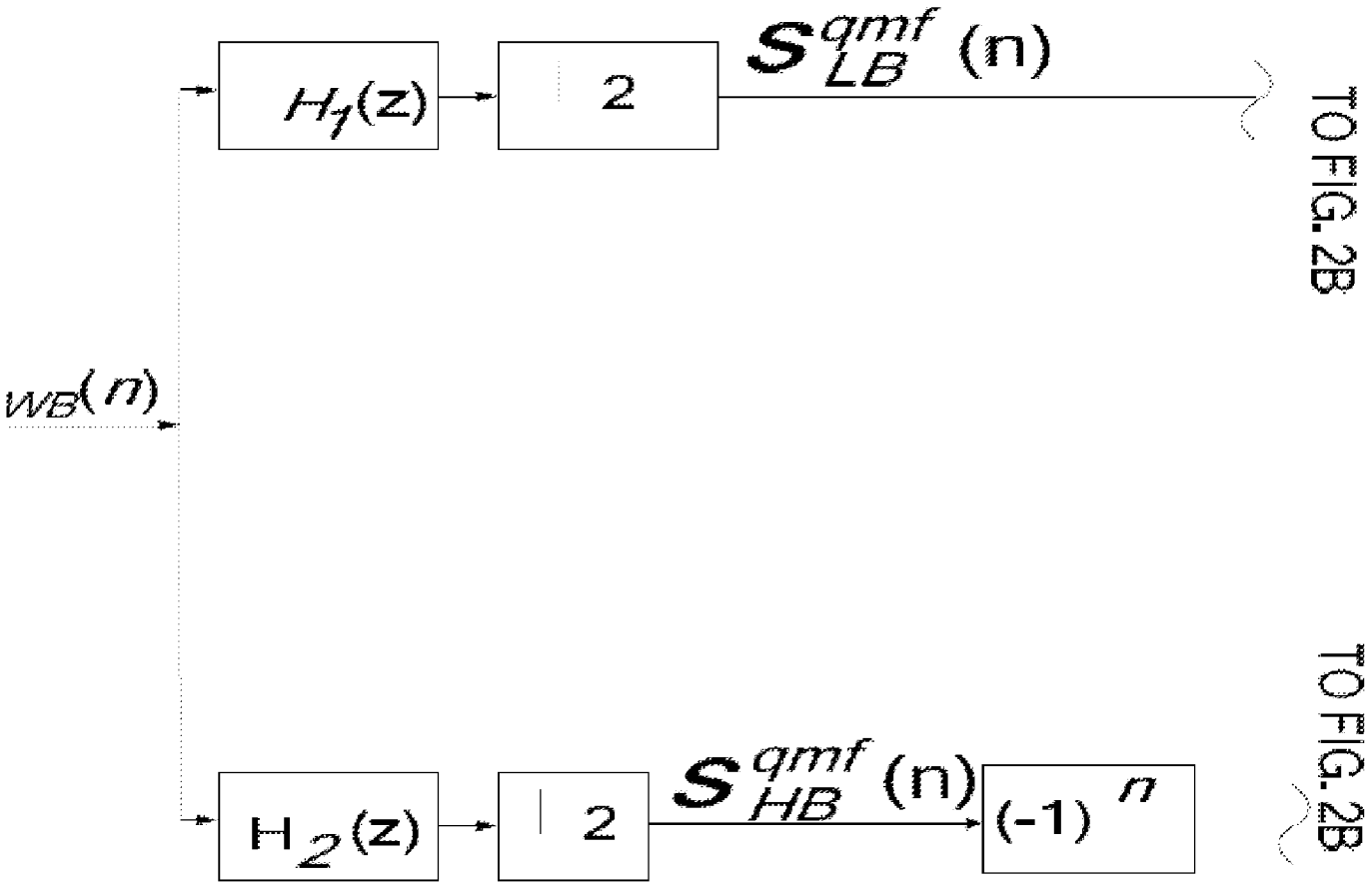
FIG. 2A (Prior Art)
FIG. 2 is a schematic diagram of a G.729.1 encoder.
Figure 2B:
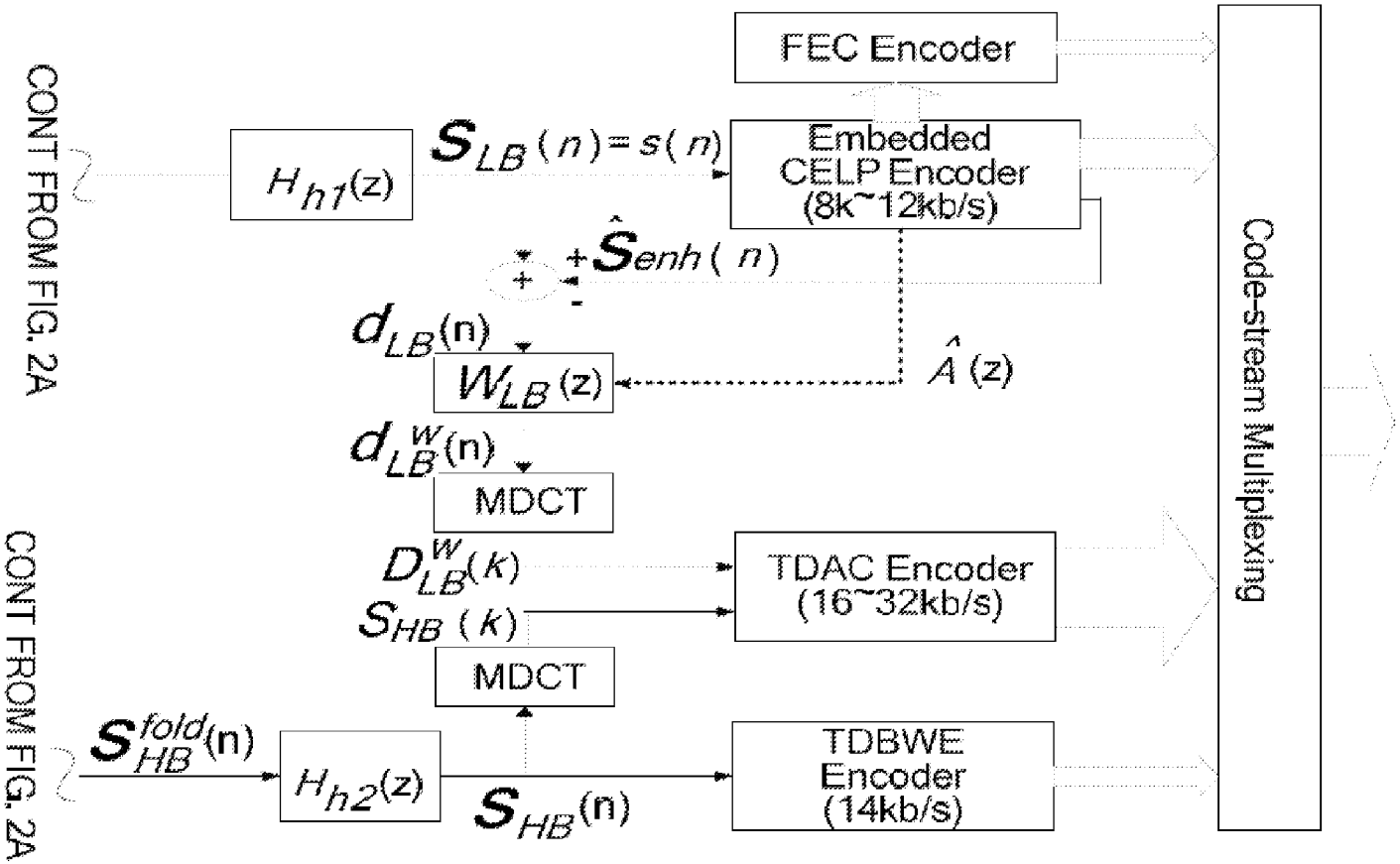

Referring to FIG. 2, a functional block diagram showing the G.729.1 encoder is provided. The encoder operates in a 20 ms input superframe. By default, the input signal $S_{WB}(n)$ is sampled at 16000 Hz. Therefore, the input superframe has a length of 320 samples.

First, the input signal $S_{WB}(n)$ is divided by a QMF filter ($H_1(z)$, $H_2(z)$) into two subbands. The lower subband signal $S_{LB}^{qmf}(n)$ is pre-processed at a high pass filter having a cut-off frequency of 50 Hz. The output signal $S_{LB}(n)$ is encoded by using the 8 kbps~12 kbps Lower-band embedded Code-Excited Linear-Prediction (CELP) encoder. The difference signal $d_{LB}(n)$ between $S_{LB}(n)$ and the local synthesis signal $\hat{S}_{enh}(n)$ of the CELP encoder at the rate of 12 Kbps passes through a sense weighting filter ($W_{LB}(z)$) to obtain a signal $d_{LB}^{w}(n)$. The signal $d_{LB}^{w}(n)$ is subject to an MDCT to the frequency-domain. The weighting filter $W_{LB}(z)$ includes gain compensation, to maintain spectral continuity between the output signal $d_{LB}^{w}(n)$ of the filter and the higher subband input signal $S_{HB}(n)$.

The higher subband component is multiplied with $(-1)^n$ to be folded spectrally. A signal $S_{HB}^{fold}(n)$ is obtained. $S_{HB}^{fold}(n)$ is pre-processed by a low pass filter having a cut-off frequency of 3000 HZ. The filtered signal $S_{HB}(n)$ is encoded at a TDBWE encoder. An MDCT transform is performed on the signal $S_{HB}(n)$ to obtain a frequency-domain signal.

Finally, two sets of MDCT coefficients $D_{LB}^{w}(k)$ and $S_{HB}(k)$ and are encoded at the TDAC encoder.

In addition, some other parameters are transmitted by the Frame Erasure Concealment (FEC) encoder to improve over the errors caused when frame loss occurs during transmission.

Figure 3A:
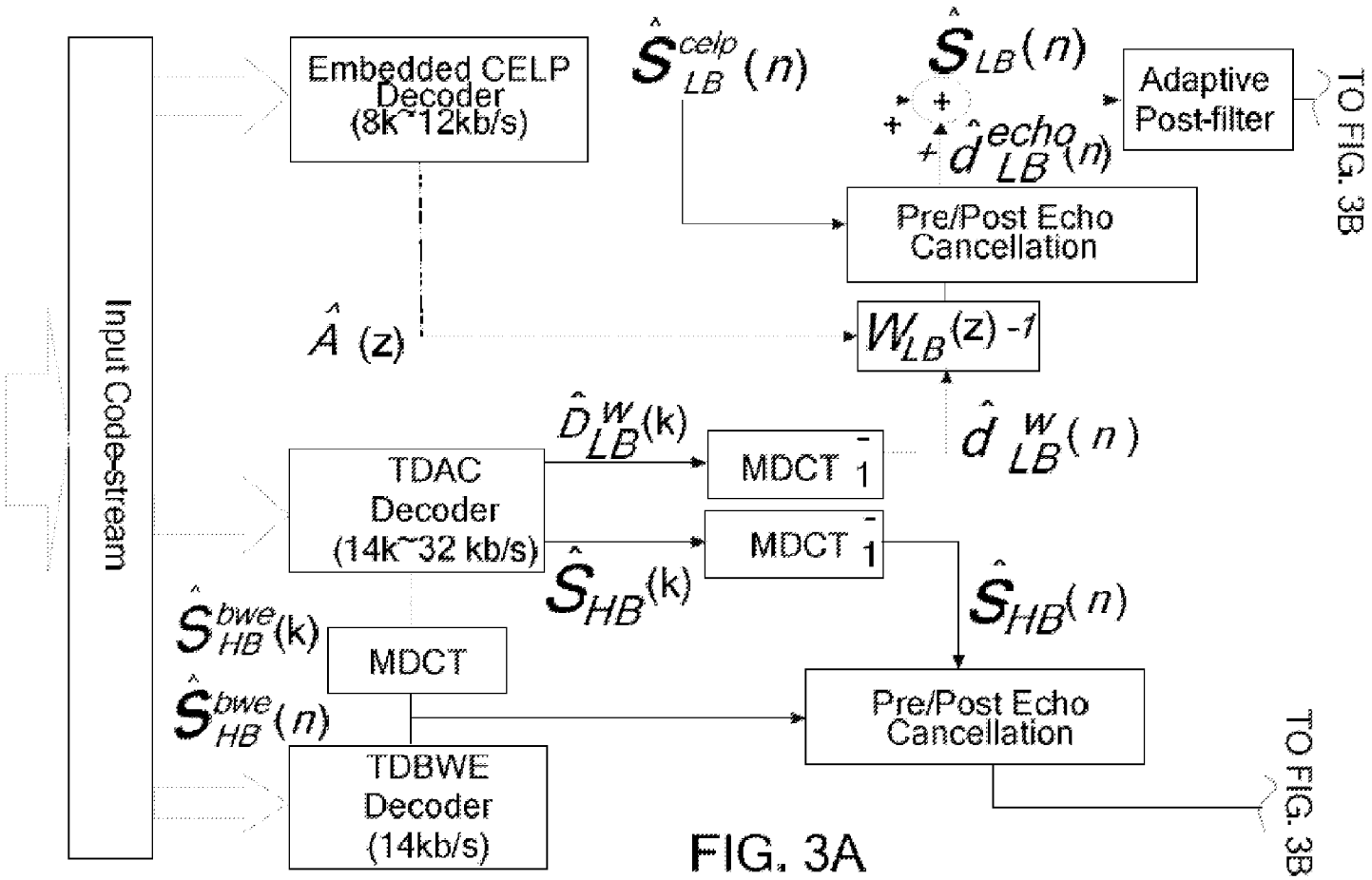
FIG. 3 is a schematic diagram of a G.729.1 decoder.
Figure 3B:
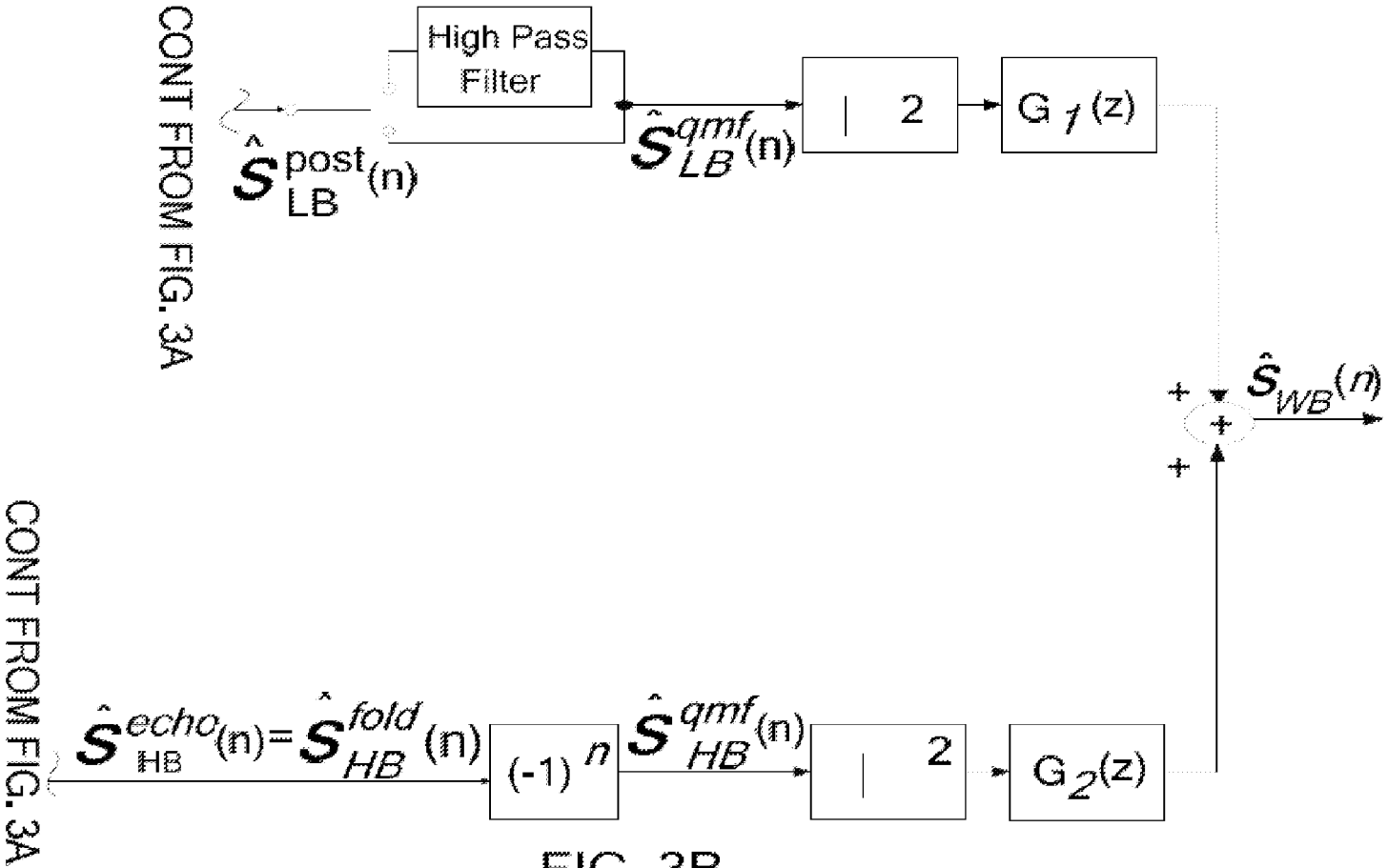

FIG. 3 is the block diagram of the decoder system. The operation mode of the decoder is determined by the number of layers of the received code stream, or equivalently, the receiving rate.

(1) If the receiving rate is 8 kbps or 12 kbps (i.e., only the first layer or the first two layers are received), an embedded CELP decoder decodes the code stream of the first layer or the first two layers, obtains a decoded signal $\hat{S}_{LB}(n)$, and performs a post-filtering to obtain $\hat{S}_{LB}^{post}(n)$, which passes through a high pass filter to obtain $\hat{s}_{LB}^{qmf}(n)=\hat{s}_{LB}^{hpf}(n)$. The QMF synthesis filter bank generates an output signal, having a high frequency synthesis signal $\hat{S}_{HB}^{qmf}(n)$ set to 0.

(2) If the receiving rate is 14 kbps (i.e., the first three layers are received), besides the CELP decoder decodes the Lower-band component, the TDBWE decoder decodes the higher-band signal component $\hat{s}_{HB}^{bwe}(n)$. An MDCT transform is performed on $\hat{s}_{HB}^{bwe}(n)$, the frequency components higher than 3000 Hz in the higher sub-band component spectrum (corresponding to higher than 7000 Hz in the16 kHz sampling rate) are set to 0, and then an inverse MDCT transform is performed. Spectrum inversion is performed after superimposition. The reconstructed higher-band signal $\hat{s}HB^{qmf}(n)$ is synthesized in the QMF filter bank with the lower-band component $\hat{s}_{LB}^{qmf}(n)=\hat{s}_{LB}^{post}(n)$ decoded by the CELP decoder, to obtain a broadband signal having a rate of 16 kHz (without high pass filtering).

(3) If the received code stream has a rate of higher than 14 kbps (corresponding to the first four layers or more layers), besides the CELP decoder obtains the lower sub-band component $\hat{s}_{LB}^{post}(n)$ by decoding and the TDBWE decoder obtains the higher sub-band component $\hat{S}_{HB}^{bwe}(n)$ by decoding, the TDAC decoder is responsible for reconstruction of MDCT coefficients and $\hat{D}_{LB}^{w}(k)$ and $\hat{S}_{HB}(k)$, corresponding to the lower band (0-4000 Hz) reconstructed weighted difference and higher band (4000-7000 Hz) reconstructed signal. (Note that in the higher band, the non-receive subband and TDAC zero code assignment subband are replaced with level adjustment subband signal $\hat{S}_{HB}^{bwe}(k)$). After inverse MDCT and overlapping addition, $\hat{D}_{LB}^{w}(k)$ and $\hat{S}_{HB}(k)$ are transformed into a time-domain signal. Then, the lower band signal $\hat{d}_{LB}^{w}(n)$ is processed by a sense weighting filter. To mitigate influence from variable encoding, the lower band and higher band signals $\hat{d}_{LB}(n)$ and $\hat{s}_{HB}(n)$ are subject to forward/backward echo detection and compression. The lower band synthesis signal $\hat{S}_{LB}(n)$ is subject to post-filtering. The Higher-band synthesis signal $\hat{s}_{HB}^{fold}(n)$ is subject to $(-1)n$ spectral folding. Then, a QMF synthesis filter bank combines and over-samples the signals $\hat{s}_{LB}^{qmf}(n)=\hat{s}_{LB}^{post}(n)$ and $\hat{s}_{HB}^{qmf}(n)$, and finally the 16 kHz broadband signal is obtained.

1.4 G.729.1 DTX/CNG System Requirements.

To save bandwidth, G.729.1 further defines the silence compression system requirements. It is required that in the presence of the background noise, the system should encode and transmit the background noise in a low-rate encoding manner without reducing the overall signal encoding quality. In other words, the DTX and CNG requirements are defined. More importantly, it is required that its DTX/CNG system should be compatible with G.729B. Although a G.729B based DTX/CNG system may be transplanted simply to G.729.1, two problems remain to be settled. First, the two encoders process frames of different lengths, and thus direct transplantation may be problematic. Moreover, the 729B based DTX/CNG systems are relatively simple, especially the parameter extraction part. To meet the G.729.1 DTX/CNG system requirements, the 729B based DTX/CNG systems should be extended. Second, G.729.1 processes signals having a broadband and G.729B processes signals having a narrow band. A scheme for processing the Higher-band component of the background noise signal (4000 Hz-7000 Hz) should be added to the G.729.1 based DTX/CNG system so as to form a complete system.

In G.729.1, the higher band and the lower band of the background noise may be processed separately. The higher band processing may be relatively simple. The encoding of the background noise characteristic parameters may refer to the TDBWE encoding of the speech encoder. A decision part simply compares the stability of the frequency-domain envelope and the stability of the time-domain envelope. The technical solution and the problem of the invention focus on the low frequency band, i.e., the Lower band. The following G.729.1 DTX/CNG system may refer to processes related to the Lower-band DTX/CNG component.

Figure 4:
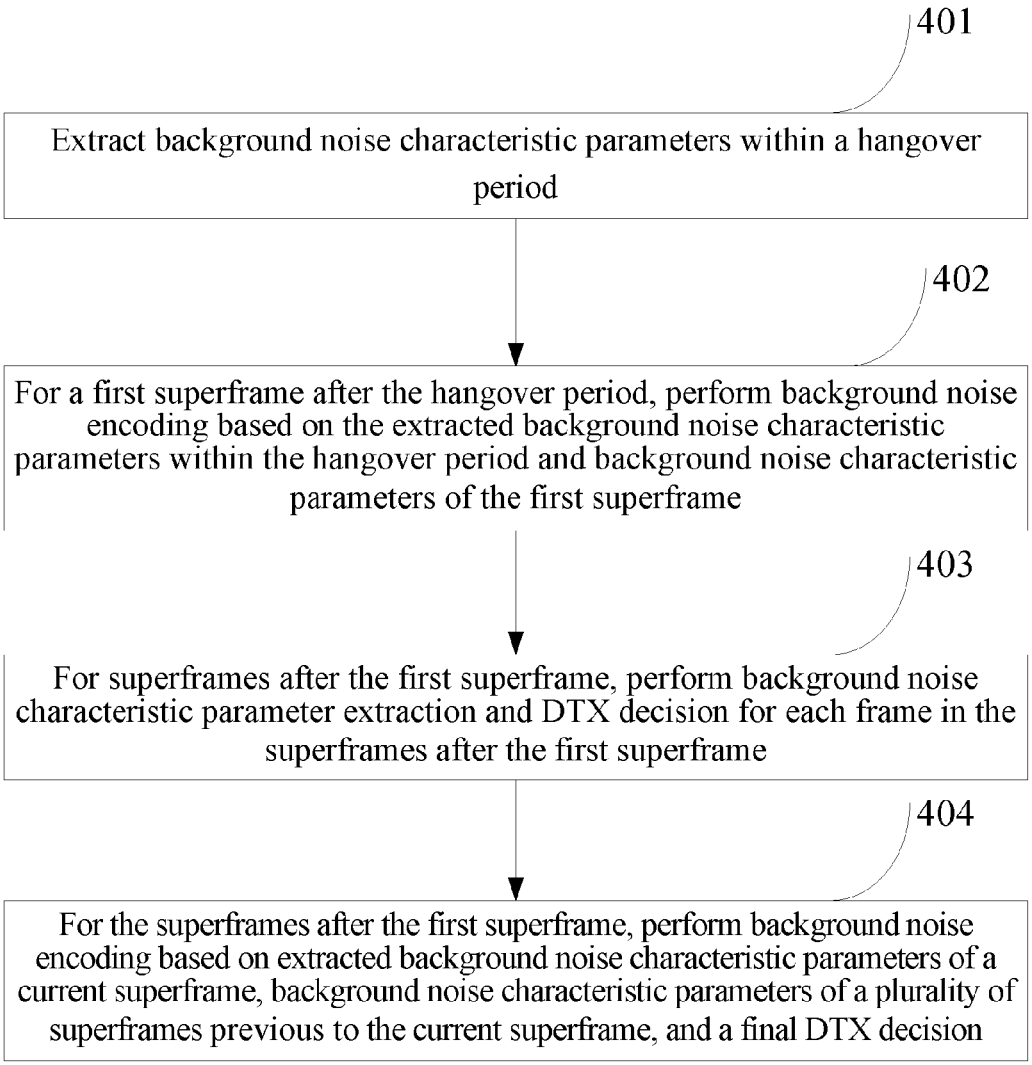
FIG. 4 is a flowchart of an encoding method according to a first embodiment of the present invention.

FIG. 4 shows a first embodiment of an encoding method according to the invention, including steps as follows.

In step 401, background noise characteristic parameter(s) are extracted within a hangover period.

In step 402, for a first superframe after the hangover period, background noise encoding is performed based on the extracted background noise characteristic parameter(s) within the hangover period and background noise characteristic parameter(s) of the first superframe, so as to obtain the first SID frame.

In step 403, for superframes after the first superframe, background noise characteristic parameter extraction and DTX decision are performed for each frame in the superframes after the first superframe.

In step 404, for the superframes after the first superframe, background noise encoding is performed based on extracted background noise characteristic parameter(s) of a current superframe, background noise characteristic parameters of a plurality of superframes previous to the current superframe, and a final DTX decision.

According to an embodiment of the invention, background noise characteristic parameter(s) are extracted within a hangover period; for a first superframe after the hangover period, background noise encoding is performed based on the extracted background noise characteristic parameter(s)

within the hangover period and background noise characteristic parameter(s) of the first superframe.

For superframes after the first superframe, background noise characteristic parameter extraction and DTX decision are performed for each frame in the superframes after the first superframe.

For the superframes after the first superframe, background noise encoding is performed based on extracted background noise characteristic parameter(s) of a current superframe, background noise characteristic parameters of a plurality of superframes previous to the current superframe, and a final DTX decision. The following advantages may be achieved.

First, the signal communication bandwidth may be reduced substantially while the signal encoding quality is guaranteed.

Second, the requirements of the G.729.1 system specification may be satisfied by extending the G.729B system.

Third, the background noise may be encoded more accurately by a flexible and precise extraction of the background noise characteristic parameter.

In various embodiments of the invention, to meet the requirements for the technical standards related to G.729.1, each superframe may be set to 20 ms and a frame contained in each superframe may be set to 10 ms. With the various embodiments of the invention, extension of G.729B may be achieved to meet the technical requirements of G.729.1. Meanwhile, those skilled in the art may understand that the technical solutions provided in the various embodiments of the invention may also be applied for non G.729.1 systems. Similarly, the background noise may have lower bandwidth occupancy and higher communication quality may be brought. In other words, the application of the invention is not limited to the G.729.1 system.

Detailed descriptions will be made below to the second embodiment of the encoding method of the invention with reference to the accompanying drawings.

In G729.1 and G729B, frames of different lengths are encoded, 20 ms per frame for the former and 10 ms per frame for the latter. In other words, one frame in G729.1 corresponds to two frames in G729B. For ease of illustration, one frame in G729.1 is referred to as a superframe and one frame in G729B is referred to as a frame herein. In description of the G729.1 DTX/CNG system, the invention mainly focuses on such a difference. That is, the G729B DTX/CNG system is upgraded and extended to adapt to the system characteristics of ITU729.1.

I. Noise Learning.

First, the initial 120 ms of the background noise is encoded at the speech encoding rate.

To have an accurate extraction of the background noise characteristic parameter, within a certain time period after the speech frame ends (the VAD result indicates that the current frame has changed from the active speech to the inactive background noise), the background noise processing phase is not started immediately. Rather, the background noise continues to be encoded at the speech encoding rate. Such a hangover period typically lasts 6 superframes, i.e., 120 ms (AMR and AMRWB may be referred to).

Second, within the hangover period, for each 10 ms frame of each superframe, the autocorrelation coefficients $r'_{t,k}(j)$, j=0 . . . 10 of the background noise may be buffered, where t is the superframe index and k=1, 2 are the indexes for the first and second 10 ms frames in each superframe. These autocorrelation coefficients may reflect the characteristics of the background noise during the hangover phase. When the background noise is encoded, these autocorrelation coefficients may be used to precisely extract the background noise characteristic parameter so that the background noise may be encoded more precisely. In practical applications, the duration of noise learning may be set as needed, not limited to 120 ms. The hangover period may be set to any other value as needed.

II. Encoding the First Superframe After the Hangover Phase.

Figure 5:
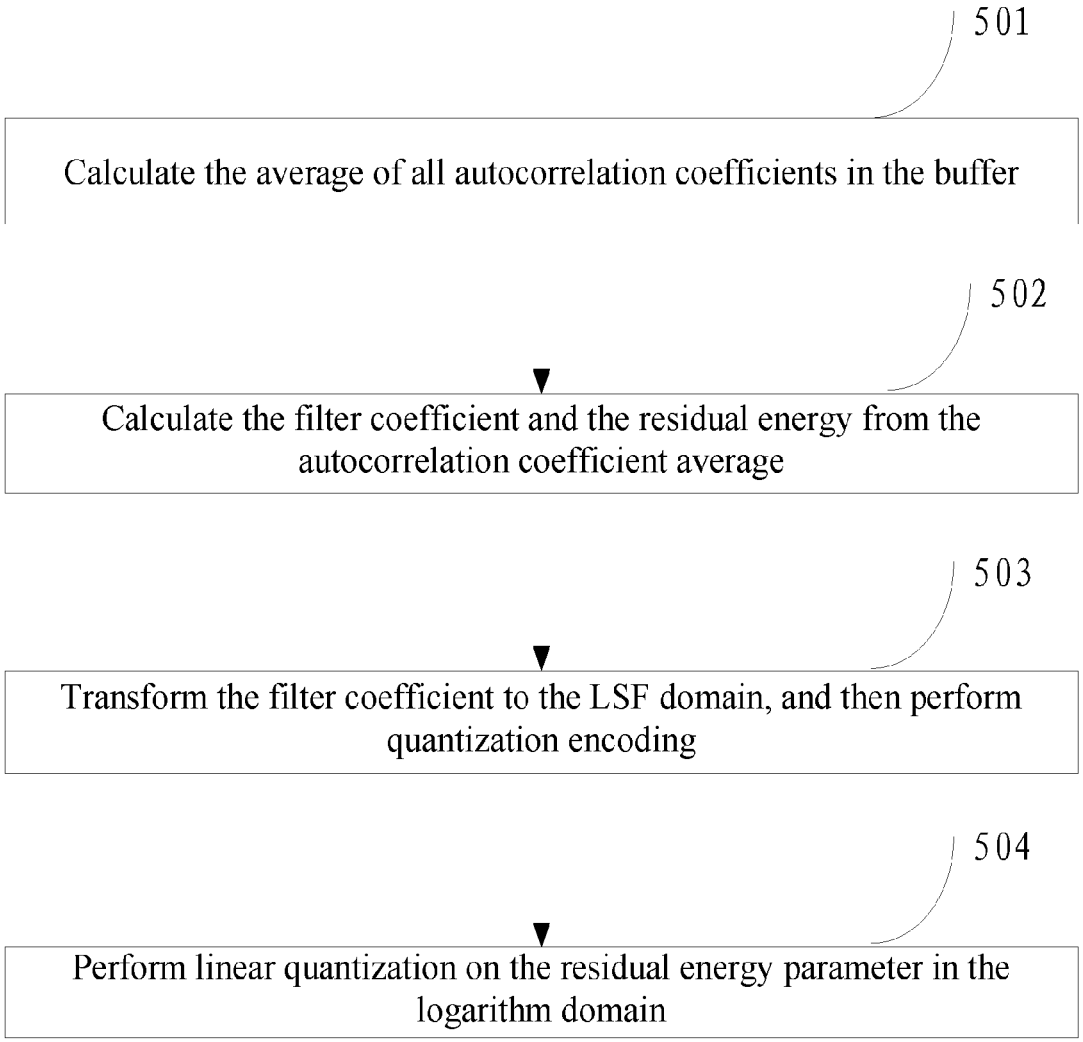
FIG. 5 is a flowchart of encoding the first superframe.

After the hangover phase comes to an end, the background noise is processed as the background noise processing. FIG. 5 is the flow of encoding the first superframe, including steps as follows.

In the first superframe after the hangover phase ends, the background noise characteristic parameters extracted during the noise learning phase and the current superframe may be encoded, to obtain the first SID superframe. In the first superframe after the hangover phase, background noise parameters are encoded and transmitted. Thus, this superframe is generally referred to as the first SID superframe. The encoded first SID superframe is transmitted to the decoding side and decoded. Since one superframe corresponds to two 10 ms frames, in order to accurately obtain the encoding parameter, the background noise characteristic parameters $A_t(z)$ and $E_t$ will will be extracted from the second 10 ms frame.

The LPC filter $A_t(z)$ and the residual energy $E_t$ are calculated as follows.

In step 501, the average of all autocorrelation coefficients in the buffer is calculated:

$$R^t(j) = \frac{1}{2 * N_{cur}} \sum_{i=t-N_{cur}+1}^{t} \sum_{k=1}^{2} (r')_{i,k}(j), \quad j = 0 \ldots 10$$

where $N_{cur}$=5, i.e., the buffer size is 10 10 ms frames.

In step 502, the LPC filter $A_t(z)$ is calculated from the autocorrelation coefficient average $R^t(j)$ based on the Levinson-Durbin algorithm, where the coefficient is $a_t(j)$, j=0, . . . , 10. the residual energy $E_t$ is also calculated from the autocorrelation coefficient average $R^t(j)$ based on the Levinson-Durbin algorithm, which may be taken as a simple estimate of the energy parameter of the current superframe.

In practical applications, to obtain a more stable estimate of the superframe energy parameter, a long-term smoothing may be performed on the estimated residual energy $E_t$, and the smoothed energy estimate E_LT may be taken as the final estimate of the energy parameter of the current superframe, which is reassigned to $E_t$. The smoothing operation is as follows:

$$E_LT = \alpha E_LT + (1-\alpha) E_t$$

$$E_t = E_LT$$

where $0<\alpha<1$. In a preferred embodiment, $\alpha$ may be 0.9 or may be set to any other value as needed.

In step 503, the algorithm transforms the LPC filter coefficient $A_t(z)$ to the LSF domain, and then performs quantization encoding.

In step 504, Linear quantization is performed on the residual energy parameter $E_t$ in the logarithm domain.

After the encoding of the background noise Lower-Band component is completed, these encoded bits are encapsulated in an SID frame and transmitted to the decoding side. Thus, the encoding of the Lower-band component of the first SID frame is completed.

In the embodiments of the invention, when the Lower-band component of the first SID frame is encoded, the characteristics of the background noise during the hangover phase are fully considered. The characteristics of the background noise during the hangover phase are reflected in the encoding parameters so that these encoding parameters represent the characteristics of the current background noise to the most extent. Therefore, the parameter extraction in the embodiments of the invention may be more accurate and reasonable than G.729B.

III. DTX Decision.

For ease of illustration, it is assumed that the extracted parameter is denoted in the form of $PARA_{t,k}$, where t is the superframe index, and "k=1, 2" are the indexes for the first and second 10 ms frames in each superframe. For non-speech superframes other than the first superframe, parameter extraction and DTX decision may be performed for each 10 ms frame.

Figure 6:
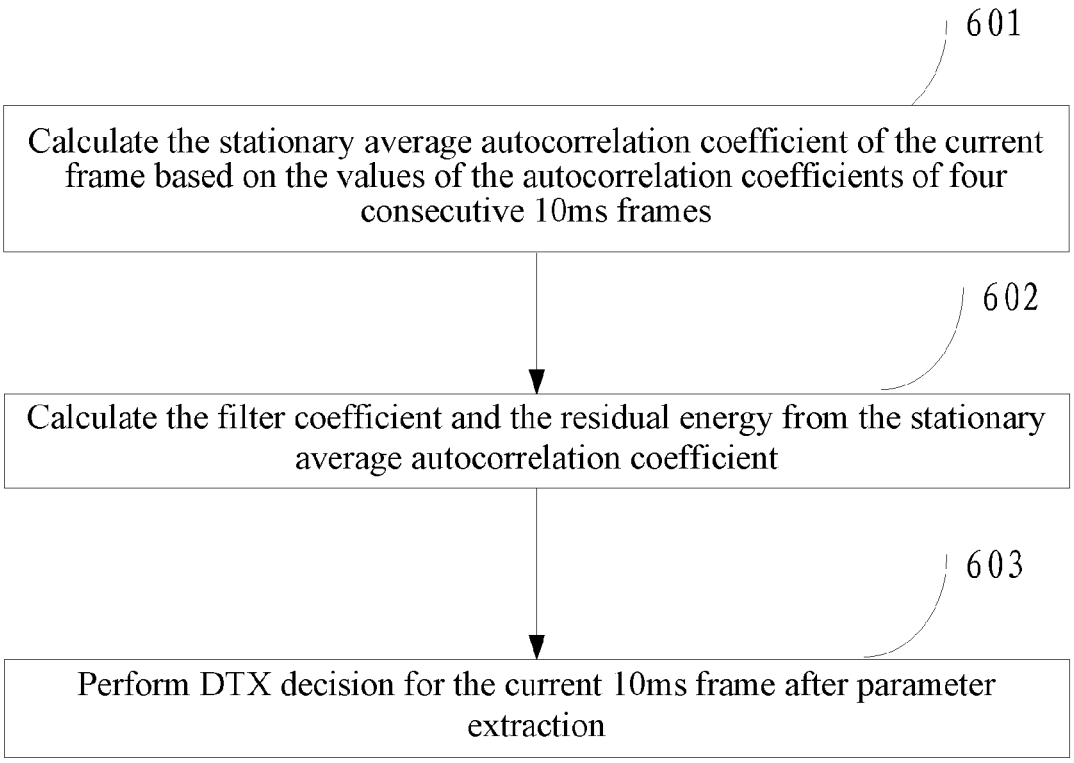
FIG. 6 is a flowchart showing a Lower-band component parameter extraction and a DTX decision.

FIG. 6 is a flow chart showing a Lower-band component parameter extraction and a DTX decision, including steps as follow.

First, background noise parameter extraction and DTX decision are performed for the first 10 ms frame after the first superframe.

For the first 10 ms frame, the spectral parameter $A_{t,1}(z)$ and the excitation energy parameter $E_{t,1}$ of the background noise may be calculated as follows.

In step 601, the stationary average autocorrelation coefficient $R^{t,1}(j)$ of the current frame may be calculated based on the values of the autocorrelation coefficients of four recent consecutive 10 ms frames, $r'_{t,1}(j)$, $r'_{(t-1),2}(j)$, $r'_{(t-1),1}(j)$ and $r'_{(t-2),2}(j)$:

$$R^{t,1}(j)=0.5*r_{min\ 1}(j)+0.5*r_{min\ 2}(j), j=0 \ldots 10$$

where $r_{min\ 1}(j)$ and $r_{min\ 2}(j)$ represent the autocorrelation coefficients having the next smallest and the next-next smallest autocorrelation coefficient norm values among $r'_{t,1}(j)$, $r'_{(t-1),2}(j)$, $r'_{(t-1),1}(j)$, and $r'_{(t-2),2}(j)$, that is, the autocorrelation coefficients of two 10 ms frames having the intermediate autocorrelation coefficient norm values excluding the largest and smallest autocorrelation coefficient norm values.

The autocorrelation coefficient norms of $r'_{t,1}(j)$, $r'_{(t-1),2}(j)$, $r'_{(t-1),1}(j)$, and $r'_{(t-2),2}(j)$ are as follows:

$$norm_{t,1} = \sum_{j=0}^{10} r'^{2}_{t,1}(j)$$

$$norm_{(t-1),2} = \sum_{j=0}^{10} r'^{2}_{(t-1),2}(j)$$

$$norm_{(t-1),1} = \sum_{j=0}^{10} r'^{2}_{(t-1),1}(j)$$

$$norm_{(t-2),2} = \sum_{j=0}^{10} r'^{2}_{(t-2),2}(j)$$

The four autocorrelation coefficient norm values are sorted, with $r_{min\ 1}(j)$ and $r_{min\ 2}(j)$ corresponding to the autocorrelation coefficients of two 10 ms frames having the intermediate autocorrelation coefficient norm values.

In step 602, the LPC filter $A_{t,1}(z)$ of the background noise is calculated from the stationary average autocorrelation coefficient $R^{t,1}(j)$ of the current frame based on the Levinson-Durbin algorithm, where the coefficients are $a_t(j)$, j=0, . . . , 10. the residual energy $E_{t,1}$ is also calculated from the stationary average autocorrelation coefficient $R^{t,1}(j)$ of the current frame based on the Levinson-Durbin algorithm.

In practical applications, to obtain a more stable estimate of the frame energy, a long-term smoothing may be performed on the estimated $E_{t,1}$, and the smoothed energy estimate E_LT may be taken as the excitation energy estimate of current frame, which is reassigned to $E_{t,1}$. The operations are as follows:

$$E_LT=\alpha E_LT+(1-\alpha)E_{t,1}$$

$$E_{t,1}=E_LT$$

where α is 0.9.

In step 603, after parameter extraction, DTX decision is performed for the current 10 ms frame. Specifically, DTX decision is as follows.

The algorithm compares the Lower-band component encoding parameter in the previous SID superframe (the SID superframe is a background noise superframe to be encoded and transmitted after being subject to DTX decision. If the DTX decision indicates that the superframe is not transmitted, it is not named as an SID superframe) with the corresponding encoding parameter of the current 10 ms frame. If the current LPC filter coefficient is largely different from the LPC filter coefficient in the previous SID superframe or the current energy parameter is largely different from the energy parameter of the previous SID superframe (see the following algorithm), the parameter change flag of the current 10 ms frame flag_change_first is set to 1. Otherwise, it is cleared to zero. The specific determining method in this step is similar to G.729B.

First, it is assumed that the coefficient of the LPC filter $A_{sid}(z)$ in the previous SID superframe is $a_{sid}(j)$, j=0 . . . 10. If the Itakura distance between the LPC filters of the current 10 ms frame and the previous SID superframe exceeds a certain threshold, flag_change_first is set to 1. Otherwise, it is set to 0.

$$\text{if} \quad \left(\sum_{j=0}^{10} R_a(i) \times R^{t,1}(i) > E_{t,1} \times thr\right)$$

$$\text{else} \quad \begin{array}{l} \text{flag_change_first} = 1 \\ \text{flag_change_first} = 0 \end{array}$$

where thr is a specific threshold value, generally within the range from 1.0 to 1.5. In this embodiment, it is 1.342676475. $R_a(j)$, j=0 . . . 10 are the autocorrelation coefficients of the LPC filter coefficients of the previous SID superframe.

$$\begin{cases} R_a(j) = 2\sum_{k=0}^{10-j} a_{sid}(k) \times a_{sid}(k+j) & \text{if}(j \neq 0) \\ R_a(0) = \sum_{k=0}^{10} a_{sid} \end{cases}$$

Then, the average of the residual energies of four 10 ms frames in total, i.e., the current 10 ms frame and three recent 10 ms frames, may be calculated:

$$\overline{E}_{t,1}=(E_{t,1}+E_{t-1,2}+E_{t-1,1}+E_{t-2,2})/4$$

Note that if the current superframe is the second superframe during the noise encoding phase (that is, its previous superframe is the first superframe), the value of $E_{t-2,2}$ is 0. $\overline{E}_{t,1}$ is quantized with a quantizer in the logarithmic domain. The decoded logarithmic energy $E_{q,1}$ is compared with the decoded logarithmic energy $E_q^{sid}$ of the previous SID superframe. If they are different by more than 3 dB, flag_change_first is set to 1. Otherwise, it is set to 0:

```
if abs(E_q^sid − E_q,1)>3
flag_change_first=1
else
flag_change_first=0
```

To those skilled in the art, the difference between two excitation energies may be set to any other value as needed, which still falls within the scope of the invention.

After the background noise parameter extraction and the DTX decision of the first 10 ms frame, the background noise parameter extraction and the DTX decision may be performed for the second 10 ms frame.

The background noise parameter extraction and the DTX decision of the second 10 ms frame are similar to the first 10 ms frame. The related parameters of the second 10 ms frame are: the stationary average $R^{t,2}(j)$ of the autocorrelation coefficients of four consecutive 10 ms frames, the average $\overline{E}_{t,2}$ of the frame energies of four consecutive 10 ms frames, and the DTX flag flag_change_second of the second 10 ms frame.

IV. Background Noise Parameter Extraction and DTX Decision for the Lower-Band Component of the Current Superframe.

Figure 7:
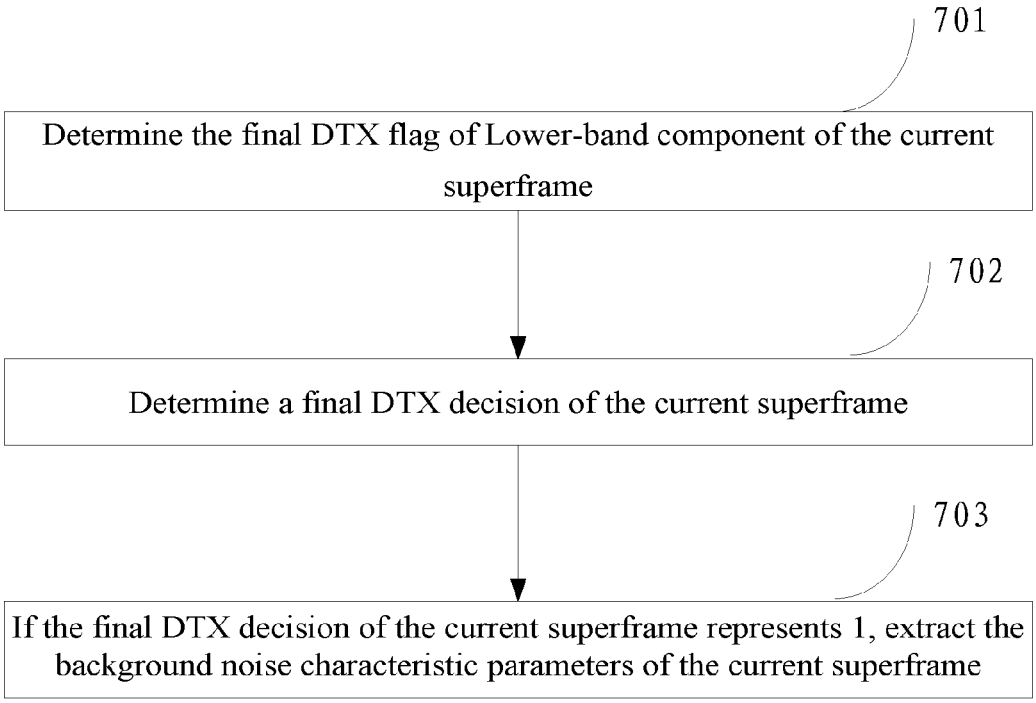
FIG. 7 is a flowchart showing a Lower-band component background noise parameter extraction and a DTX decision in the current superframe.

FIG. 7 is a flow chart showing a Lower-band component background noise parameter extraction and a DTX decision in the current superframe, including steps as follows.

In step 701, the final DTX flag flag_change of the Lower-band component of the current superframe is determined as follows:

```
flag_change=flag_change_first||flag_change_second
```

In other words, as long as the DTX decision of a 10 ms frame represents 1, the final decision of the Lower-band component of the current superframe represents 1.

In step 702, a final DTX decision of the current superframe is determined, the final DTX decision of the current superframe including the higher band component of the current superframe. Then, the characteristics of the higher band component should also be taken into account. The final DTX decision of the current superframe is determined by the Lower-band component and the Higher-band component together. If the final DTX decision of the current superframe represents 1, step 703 is performed. If the final DTX decision of the current superframe represents 0, no decoding is performed and a NODATA frame containing no data is sent to the decoding side.

In step 703, if the final DTX decision of the current superframe represents 1, the background noise characteristic parameter(s) of the current superframe is extracted. The sources from which the background noise characteristic parameter(s) of the current superframe is extracted, may be parameters of the two current 10 ms frames. In other words, the parameters of the current two 10 ms frames are smoothed to obtain the background noise encoding parameter of the current superframe. The process for extracting the background noise characteristic parameter and smoothing the background noise characteristic parameter may be as follows.

First, a smoothing factor smooth_rate is determined:

```
if (flag_change_first==0 & &flag_change_second==1)
smooth_rate=0.1
else
smooth_rate=0.5
```

In other words, if the DTX decision of the first 10 ms frame represents 0 and the DTX decision of the second 10 ms frame represents 1, the smoothing weight for the background noise characteristic parameter of the first 10 ms frame is 0.1 and the average weight of the background noise characteristic parameter of the second 10 ms frame is 0.9 during smoothing. Otherwise, the smoothing weights for the background noise characteristic parameters of the two 10 ms frames are both 0.5.

Then, the background noise characteristic parameters of the two 10 ms frames are smoothed, to obtain the LPC filter coefficient of the current superframe and calculate the average of the frame energies of two 10 ms frames. The process is as follows.

First, the smoothed average $R^t(j)$ may be calculated from the stationary average of the autocorrelation coefficients of the two 10 ms frames as follows:

$$R^t(j)=\text{smooth_rate}R^{t,1}(j)+(1-\text{smooth_rate})R^{t,2}(j)$$

After the smoothed average $R^t(j)$ is obtained, the LPC filter $A_t(z)$ may be obtained based on the Levinson-Durbin algorithm. The coefficients are $a_t(j)$, j=0, . . . , 10.

Then, the average $\overline{E}_t$ of the frame energies of the two 10 ms frames may be calculated as:

$$\overline{E}_t=\text{smooth_rate}\overline{E}_{t,1}+(1-\text{smooth_rate})\overline{E}_{t,2}$$

In this way, the encoding parameters of the Lower-band component of the current superframe may be obtained: the LPC filter coefficient and the frame energy average. The background noise characteristic parameter extraction and the DTX control have fully considered the characteristics of each 10 ms frame in the current superframe. Therefore, the algorithm is precise.

VI. SID Frame Encoding.

Similar to G.729B, the final encoding of the spectral parameters of the SID frame have considered the stability between consecutive noise frames. The specific operations are similar to G.729B.

First, the average LPC filter $\overline{A}_p(z)$ of $N_p$ superframes previous to the current superframe is calculated. The average of the autocorrelation function $\overline{R}_p(j)$ is used here. Then, $\overline{R}_p(j)$ is fed to the Levinson-Durbin algorithm so as to obtain $\overline{A}_p(z)$. $\overline{R}_p(j)$ is represented as:

$$\overline{R}_p(j)=\frac{1}{2*N_p}\sum_{i=t-1-N_p}^{t-1}\sum_{k=1}^{2}r'_{i,k}(j),\quad j=0\ \ldots\ 10$$

where the value of $N_p$ is fixed at 5. Thus, the SID-LPC filter is given by:

$$A_{sid}(z)=\begin{cases}A_t(z) & \text{if distance}(A_t(z),\overline{A}_p(z))\geq thr3\\ \overline{A}_p(z) & \text{otherwise}\end{cases}$$

In other words, the algorithm will calculate the average LPC filter coefficient $\overline{A}_p(z)$ of several previous superframes. Then, it is compared with the current LPC filter coefficient $A_t(z)$. If they have a slight difference, when the LPC coefficient is quantized, the average $\overline{A}_p(z)$ several previous superframes will be selected for the current superframe. Otherwise, $A_t(z)$ of the current superframe is selected. The specific comparison method is similar to the DTX decision method for the 10 ms frame in step 602, where thr3 is a specific threshold value, generally between 1.0 and 1.5. In this embodiment, it is 1.0966466. Those skilled in the art may take any other value as needed, which still falls within the scope of the invention.

After the LPC filter coefficients are selected, the algorithm may transform these LPC filter coefficients to the LSF domain. Then, quantization encoding is performed. The selection manner for the quantization encoding is similar to the quantization encoding manner in G.729B.

Linear quantization is performed on the energy parameter in the logarithm domain. Then, it is encoded. Thus, the encoding of the background noise is completed. Then, these encoded bits are encapsulated into an SID frame.

VII. The CNG Scheme.

In the encoding based on a CELP model, in order to obtain the optimal encoding parameter, the encoding side also includes a decoding process, which is no exception for the CNG system. That is, in G.729.1, the encoding side also should contain a CNG module. For the CNG in G.729.1, its process flow is based on G.729B. Although the frame length is 20 ms, the background noise is still processed with 10 ms as the basic data processing length. From the previous section, it may be known that the encoding parameter of the first SID superframe is encoded in the second 10 ms frame. But in this case, the system should generate the CNG parameters in the first 10 ms frame of the first SID superframe. Obviously, the CNG parameters of the first 10 ms frame of the first SID superframe cannot be obtained from the encoding parameter of the SID superframe, but can be obtained from the previous speech encoding superframes. Due to this particularity, the CNG scheme in the first 10 ms frame of the first SID superframe in G.729.1 is different from G.729B. Compared with the G.729B CNG scheme described previously, the differences are as follows.

(1) The target excited gain $\tilde{G}_t$ is defined by a long-term smoothed fixed codebook gain $LT_\overline{G}_f$ which is smoothed from the fixed codebook gain of the speech encoding frames:

$$\tilde{G}_t = LT_\overline{G}_f * \gamma$$

where $0<\gamma<1$. In this embodiment, $\gamma=0.4$ may be selected.

(2) The LPC filter coefficient $A_{sid}(z)$ is defined by a long-term smoothed LPC filter coefficient $LT_\overline{A}(z)$ which is smoothed from the LPC filter coefficient of the speech encoding frames.

$$A_{sid}(z) = LT_\overline{A}(z)$$

Other operations are similar to 729B.

Let the fixed codebook gain and the LPC filter coefficient which is smoothed from the fixed codebook gain and the LPC filter coefficient of the speech encoding frames respectively be gain_code and $A_q(z)$ respectively. These long-term smoothed parameters may be calculated as follows.

$$LT_\overline{G}_f = \beta LT_\overline{G}_f + (1-\beta)\text{gain_code}$$

$$LT_\overline{A}(z) = \beta LT_\overline{A}(z) + (1-\beta)A_q(z)$$

The above operations perform smoothing in each subframe of the speech superframe, where the range of the smoothing factor $\beta$ is $0<\beta<1$. In this embodiment, $\beta$ is 0.5.

Additionally, except that the first 10 ms frame of the first SID superframe is slightly different from 729B, the CNG manner for all the other 10 ms frames is similar to G.729B.

In the above embodiments, the hangover period is 120 ms or 140 ms.

In the above embodiments, the process of extracting the background noise characteristic parameters within the hangover period may include, for each frame of a superframe within the hangover period, storing an autocorrelation coefficient of the background noise of the frame.

In the above embodiments, the process of, for the first superframe after the hangover period, performing background noise encoding based on the extracted background noise characteristic parameters within the hangover period and the background noise characteristic parameters of the first superframe may include, within a first frame and a second frame of the first superframe after the hangover period, storing an autocorrelation coefficient of the background noise of each frame, and within the second frame, extracting an LPC filter coefficient and a residual energy $E_t$ of the first superframe based on the extracted autocorrelation coefficients of the two frames and the background noise characteristic parameters within the hangover period, and performing background noise encoding.

In the above embodiments, the process of extracting the LPC filter coefficient may include calculating the average of the autocorrelation coefficients of the first superframe and four superframes which are previous to the first superframe and within the hangover period, and calculating the LPC filter coefficient from the average of the autocorrelation coefficients based on a Levinson-Durbin algorithm.

The process of extracting the residual energy $E_t$ may include: calculating the residual energy based on the Levinson-Durbin algorithm.

The process of performing background noise encoding within the second frame may include transforming the LPC filter coefficient into the LSF domain for quantization encoding, and performing linear quantization encoding on the residual energy in the logarithm domain.

In the above embodiments, after the residual energy is calculated and before the residual energy is quantized, the method may further include performing a long-term smoothing on the residual energy, the smoothing algorithm being $E_LT=\alpha E_LT+(1-\alpha)E_t$, with $0<\alpha<1$, and the value of the long-term smoothed energy estimate E_LT is the value of the residual energy.

In the above embodiments, the process of, for superframes after the first superframe, performing background noise characteristic parameter extraction for each frame in the superframes after the first superframe may include calculating the stationary average autocorrelation coefficient of the current frame based on the values of the autocorrelation coefficients of four recent consecutive frames, the stationary average autocorrelation coefficient being the average of the autocorrelation coefficients of two frames having intermediate norm values of autocorrelation coefficients in the four recent consecutive frames, and calculating the LPC filter coefficient and the residual energy of the background noise from the stationary average autocorrelation coefficient based on the Levinson-durbin algorithm.

In the above embodiments, after the residual energy is calculated, the method may further include performing a long-term smoothing on the residual energy to obtain the energy estimate of the current frame, the smoothing algorithm being:

$$E_LT=\alpha E_LT+(1-\alpha)E_{t,k}, \text{ with } 0<\alpha<1, \text{ and}$$

the smoothed energy estimate of the current frame is assigned as the residual energy, with the assigning algorithm being:

$$E_{t,k}=E_LT,$$

where k=1, 2, representing the first frame and the second frame respectively.

In the various embodiments, $\alpha=0.9$.

In the above embodiments, the process of, for superframes after the first superframe, performing DTX decision for each frame in the superframes after the first superframe may include, if the LPC filter coefficient of the current frame and the LPC filter coefficient of the previous SID superframe exceed a preset threshold or the energy estimate of the current frame is substantially different from the energy estimate of the previous SID superframe, setting a parameter change flag of the current frame to 1, and, if the LPC filter coefficient of the current frame and the LPC filter coefficient of the previous SID superframe do not exceed the preset threshold or the energy estimate of the current frame is not substantially different from the energy estimate of the previous SID superframe, setting the parameter change flag of the current frame to 0.

In the above embodiments, the energy estimate of the current frame being substantially different from the energy estimate of the previous SID superframe may include, calculating the average of the residual energies of four frames (the current 10 ms frame and three recent preceding frames) as the energy estimate of the current frame, quantizing the average of the residual energies with a quantizer in the logarithmic domain, and if the difference between the decoded logarithmic energy and the decoded logarithmic energy of the previous SID superframe exceeds a preset value, determining that the energy estimate of the current frame is substantially different from the energy estimate of the previous SID superframe.

In the above embodiments, the process of performing DTX decision for each frame in the superframes after the first superframe may include, if a frame of the current superframe has a DTX decision of 1, the DTX decision for the Lower-band component of the current superframe represents 1.

In the above embodiments, if a final DTX decision of the current superframe represents 1, the process of for superframes after the first superframe, performing background noise encoding based on the extracted background noise characteristic parameters of the current superframe, background noise characteristic parameters of a plurality of superframes previous to the current superframe, and a final DTX decision may include determining a smoothing factor for the current superframe, including: if the DTX decision of the first frame of the current superframe represents zero and the DTX decision of the second frame represents s 1, the smoothing factor is 0.1; otherwise, the smoothing factor is 0.5, performing parameter smoothing for the first frame and second frame of the current superframe, the smoothed parameters being the characteristic parameters of the current superframe for performing background noise encoding, the parameter smoothing may include calculating the smoothed average $R^t(j)$ from the stationary average autocorrelation coefficient of the first frame and the stationary average autocorrelation coefficient of the second frame, as follows:

$$R^t(j)=\text{smooth_rate}R^{t,1}(j)+(1-\text{smooth_rate})R^{t,2}(j),$$

where smooth_rate is the smoothing factor, $R^{t,1}(j)$ is the stationary average autocorrelation coefficient of the first frame, and $R^{t,2}(j)$ is the stationary average autocorrelation coefficient of the second frame, obtaining an LPC filter coefficient from the smoothed average $R^t(j)$ based on the Levinson-Durbin algorithm, and calculating the smoothed average $\overline{E}_t$ from the energy estimate of the first frame and the energy estimate of the second frame, as follows:

$$\overline{E}_t=\text{smooth_rate}\overline{E}_{t,1}+(1-\text{smooth_rate})\overline{E}_{t,2}, \text{ where}$$

$\overline{E}_{t,1}$ is the energy estimate of the first frame and $\overline{E}_{t,2}$ is the energy estimate of the second frame.

In the above embodiments, the process of performing background noise encoding based on the extracted background noise characteristic parameters of the current superframe, background noise characteristic parameters of a plurality of superframes previous to the current superframe, and a final DTX decision may include calculating the average of the autocorrelation coefficients of a plurality of superframes previous to the current superframe, calculating the average LPC filter coefficient of the plurality of superframes previous to the current superframe based on the average of the autocorrelation coefficients of a plurality of superframes previous to the current superframe, if the difference between the average LPC filter coefficient and the LPC filter coefficient of the current superframe is less than or equal to a preset value, transforming the average LPC filter coefficient to the LSF domain for quantization encoding if the difference between the average LPC filter coefficient and the LPC filter coefficient of the current superframe is more than the preset value, transforming the LPC filter coefficient of the current superframe to the LSF domain for quantization encoding, and performing linear quantization encoding on an energy parameter(s) in the logarithm domain.

In the above embodiments, the number of the plurality of superframes is 5. Those skilled in the art may select any other number of frames as needed.

In the above embodiments, before the process of extracting the background noise characteristic parameters within the hangover period, the method may further include encoding the background noise within the hangover period at a speech encoding rate.

Figure 8:
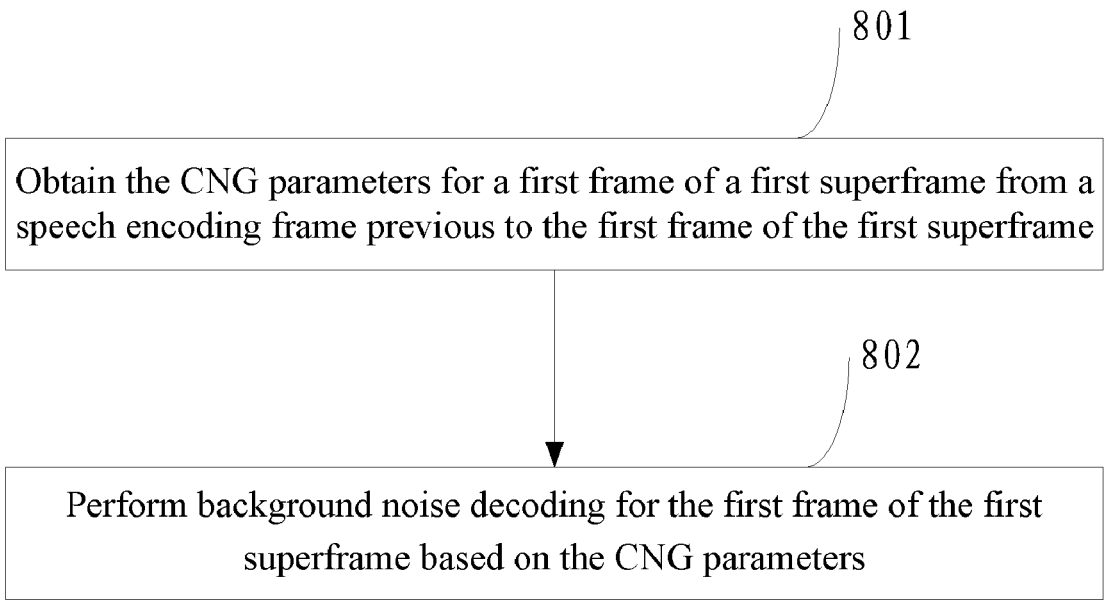
FIG. 8 is a flowchart of a decoding method according to a first embodiment of the present invention.

FIG. 8 shows a first embodiment of a decoding method according to the invention, including steps as follows.

In step 801, CNG parameters are obtained for a first frame of a first superframe from a speech encoding frame previous to the first frame of the first superframe.

In step 802, background noise decoding is performed for the first frame of the first superframe based on the CNG parameters. The CNG parameters may include a target excited gain, which is determined by a long-term smoothed fixed codebook gain which is smoothed from the fixed codebook gain of the speech encoding frames, and an LPC filter coefficient, which is defined by a long-term smoothed LPC filter coefficient which is smoothed from the LPC filter coefficient of the speech encoding frames.

In practical applications, the target gain may be determined as: target excited gain=$\gamma$*fixed codebook gain, $0<\gamma<1$.

In practical applications, the filter coefficient may be defined as a long-term smoothed filter coefficient which is smoothed from the filter coefficient of the speech encoding frames.

In the above embodiments, the long-term smoothing factor may be more than 0 and less than 1.

In the above embodiments, the long-term smoothing factor may be 0.5.

In the above embodiments, $\gamma=0.4$.

In the above embodiments, after the process of performing background noise decoding for the first frame of the first superframe, the following may be included for frames other than the first frame of the first superframe, after obtaining CNG parameters from the previous SID superframe, performing background noise decoding based on the obtained CNG parameters.

Figure 9:
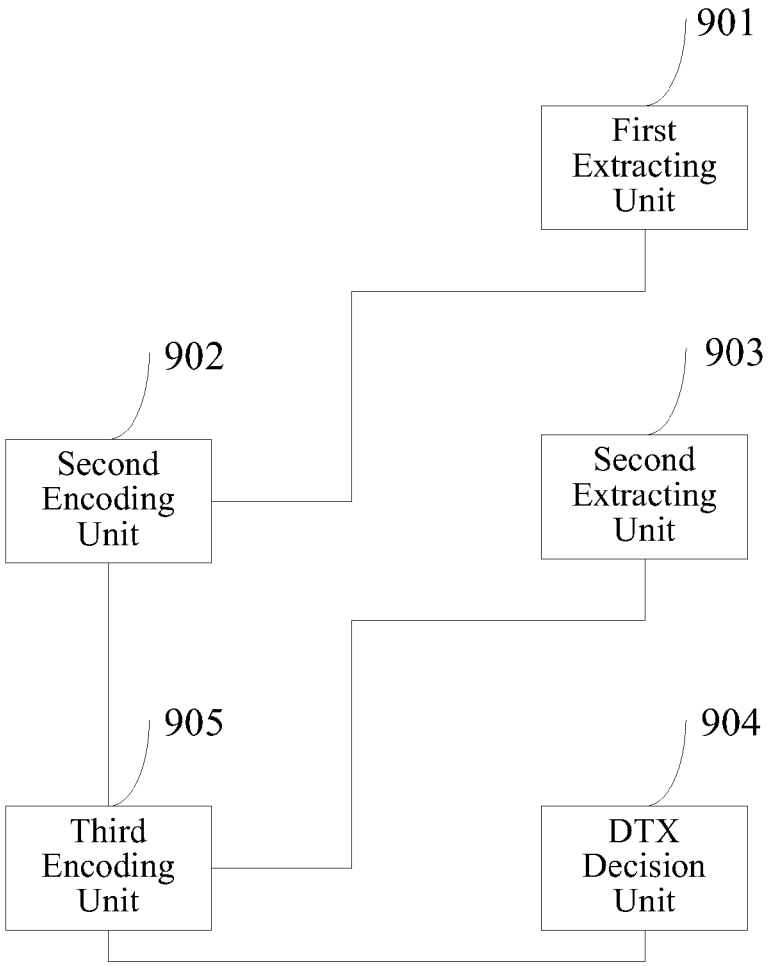
FIG. 9 is a schematic diagram of an encoding apparatus according to a first embodiment of the present invention.

FIG. 9 shows an encoding apparatus according to a first embodiment of the invention.

A first extracting unit 901 is configured to extract background noise characteristic parameters within a hangover period.

A second encoding unit 902 is configured to, for a first superframe after the hangover period, perform background noise encoding based on the extracted background noise characteristic parameters within the hangover period and background noise characteristic parameters of the first superframe.

A second extracting unit 903 is configured to, for superframes after the first superframe, perform background noise characteristic parameter extraction for each frame in the superframes after the first superframe.

A DTX decision unit 904 is configured to, for superframes after the first superframe, perform DTX decision for each frame in the superframes after the first superframe.

A third encoding unit 905 is configured to, for superframes after the first superframe, perform background noise encoding based on extracted background noise characteristic parameter(s) of a current superframe, background noise characteristic parameters of a plurality of superframes previous to the current superframe, and a final DTX decision.

In the above embodiments, the hangover period is 120 ms or 140 ms.

In the above embodiments, the first extracting unit may be a buffer module configured to, for each frame of a superframe within the hangover period, store an autocorrelation coefficient of the background noise of the each frame of the superframe within the hangover period.

In the above embodiments, the second encoding unit may include an extracting module configured to, within a first frame and a second frame of the first superframe after the hangover period, store an autocorrelation coefficient of the background noise of the corresponding first frame and second frame of the first superframe after the hangover period, and an encoding module configured to within the second frame of the first superframe after the hangover period, extract an LPC filter coefficient and a residual energy of the first superframe based on the extracted autocorrelation coefficients of the first frame and second frame and the extracted background noise characteristic parameters within the hangover period, and perform background noise encoding.

In the above embodiments, the second encoding unit may also include a residual energy smoothing module configured to perform a long-term smoothing on the residual energy, the smoothing algorithm being $E_LT=\alpha E_LT+(1-\alpha)E_t$, with $0<\alpha<1$, and the value of the smoothed energy estimate E_LT is the value of the residual energy.

In the above embodiments, the second extracting unit may include a first calculating module configured to calculate the stationary average autocorrelation coefficient of the current frame based on the values of the autocorrelation coefficients of four recent consecutive frames, the stationary average autocorrelation coefficient being the average of the autocorrelation coefficients of two frames having intermediate norm values of autocorrelation coefficients in the four recent consecutive frames, and a second calculating module configured to calculate the LPC filter coefficient and the residual energy of the background noise from the stationary average autocorrelation coefficient based on the Levinson-durbin algorithm.

In the above embodiments, the second extracting unit may further include a second residual energy smoothing module, configured to perform a long-term smoothing on the residual energy to obtain the energy estimate of the current frame, the smoothing algorithm being:

$$E_LT=\alpha E_LT+(1-\alpha)E_{t,k}, \text{ with } 0<\alpha<1, \text{ and}$$

the smoothed energy estimate of the current frame is assigned as the residual energy, with the assigning algorithm being:

$$E_{t,k}=E_LT,$$

where k=1, 2, representing the first frame and the second frame respectively.

In the above embodiments, the DTX decision unit may further include a threshold comparing module configured to, if the LPC filter coefficient of the current frame and the LPC filter coefficient of the previous SID superframe exceed a preset threshold, generate a decision command;

an energy comparing module configured to calculate the average of the residual energies of four frames (the current frame and three recent previous frames) as the energy estimate of the current frame; quantize the average of the residual energies with a quantizer in the logarithmic domain if the difference between the decoded logarithmic energy and the decoded logarithmic energy of the previous SID superframe exceeds a preset value, generate a decision command, and a first decision module, configured to set a parameter change flag of the current frame to 1 according to the decision command.

In the above embodiments, the following may be included a second decision unit, configured to: if the DTX decision for a frame of the current superframe represents 1, the DTX decision for the Lower-band component of the current superframe represents 1.

The third encoding unit may include a smoothing command module configured to, if a final DTX decision of the current superframe represents 1, generate a smoothing command, and a smoothing factor determining module configured to, upon receipt of the smoothing command, determine a smoothing factor for the current superframe.

If the DTX decision of the first frame of the current superframe represents zero and the DTX decision of the second frame represents 1, the smoothing factor is 0.1; otherwise, the smoothing factor is 0.5.

A parameter smoothing module is configured to perform parameter smoothing for the first frame and second frame of the current superframe, and the smoothed parameters being the characteristic parameters of the current superframe for performing background noise encoding, including calculating the smoothed average $R^t(j)$ from the stationary average autocorrelation coefficient of the first frame and the stationary average autocorrelation coefficient of the second frame, as follows:

$$R^t(j)=\text{smooth_rate}R^{t,1}(j)+(1-\text{smooth_rate})R^{t,2}(j), \text{ where}$$

smooth_rate is the smoothing factor, $R^{t,1}(j)$ is the stationary average autocorrelation coefficient of the first frame, and $R^{t,2}(j)$ is the stationary average autocorrelation coefficient of the second frame, obtaining an LPC filter coefficient from the smoothed average $R^t(j)$ based on the Levinson-Durbin algorithm, and calculating the smoothed average $\overline{E}_t$ from the energy estimate of the first frame and the energy estimate of the second frame, as follows:

$$\overline{E}_t=\text{smooth_rate}\overline{E}_{t,1}+(1-\text{smooth_rate})\overline{E}_{t,2}, \text{ where}$$

$\overline{E}_{t,1}$ is the energy estimate of the first frame and $\overline{E}_{t,2}$ is the energy estimate of the second frame.

In the above embodiments, the third encoding unit may include a third calculating module configured to calculate the average LPC filter coefficient of the plurality of superframes previous to the current superframe, based on the calculated average of the autocorrelation coefficients of a plurality of superframes previous to the current superframe, a first encoding module configured to, if the difference between the average LPC filter coefficient and the LPC filter coefficient of the current superframe is less than or equal to a preset value, transform the average LPC filter coefficient to the LSF domain for quantization encoding, a second encoding module configured to if the difference between the average LPC filter coefficient and the LPC filter coefficient of the current superframe is more than the preset value, transform the LPC filter coefficient of the current superframe to the LSF domain for quantization encoding, and a third encoding module, configured to: perform linear quantization encoding on an energy parameter in the logarithm domain.

In the above embodiments, $\alpha=0.9$.

In the above embodiments, the following may be included: a first encoding unit, configured to encode the background noise within the hangover period at a speech encoding rate.

The encoding apparatus of the invention has a working process corresponding to the encoding method of the invention. Accordingly, the same technical effects may be achieved as the corresponding method embodiment.

Figure 10:
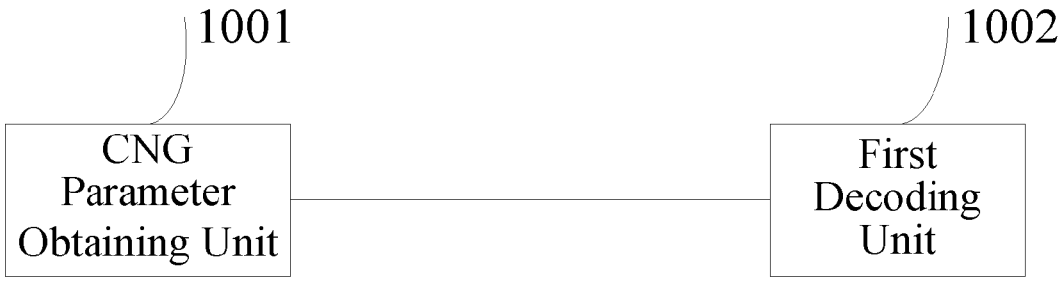
FIG. 10 is a schematic diagram of a decoding apparatus according to a first embodiment of the present invention.

FIG. 10 shows a decoding apparatus according to a first embodiment of the invention.

A CNG parameter obtaining unit 1001 is configured to obtain CNG parameters for a first frame of a first superframe from a speech encoding frame previous to the first frame of the first superframe.

A first decoding unit 1002 is configured to perform background noise decoding for the first frame of the first superframe based on the CNG parameters, the CNG parameters including a target excited gain, which is determined by a long-term smoothed fixed codebook gain which is smoothed from the fixed codebook gain of the speech encoding frames, and an LPC filter coefficient, which is defined by a long-term smoothed LPC filter coefficient which is smoothed from the LPC filter coefficient of the speech encoding frames.

In practical applications, the target excited gain may be determined as: target excited gain=$\gamma$*fixed codebook gain, $0<\gamma<1$.

In practical applications, the filter coefficient may be defined as a long-term smoothed filter coefficient which is smoothed from the filter coefficient of the speech encoding frames.

In the above embodiments, the long-term smoothing factor may be more than 0 and less than 1.

Preferably, the long-term smoothing factor may be 0.5.

In the above embodiments, the following may also be included a second decoding unit, configured to: for frames other than the first superframe, after obtaining CNG parameters from the previous SID superframe, perform background noise decoding based on the obtained CNG parameters.

In the above embodiments, $\gamma=0.4$.

The decoding apparatus of the invention has a working process corresponding to the decoding method of the invention. Accordingly, the same technical effects may be achieved as the corresponding decoding method embodiment.

The above described embodiments of the invention are not used to limit the scope of the invention. Various changes, equivalent substitutions, and improvements made within the spirit and principle of the invention are intended to fall within the scope of the invention.

What is claimed is:

1. An encoding method comprising:

extracting background noise characteristic parameters within a hangover period;

for a first superframe after the hangover period, performing background noise encoding based on the extracted background noise characteristic parameters within the hangover period and background noise characteristic parameters of the first superframe;

for superframes after the first superframe, performing background noise characteristic parameter extraction and Discontinuous Transmission (DTX) decision for each frame in the superframes after the first superframe; and for the superframes after the first superframe, performing background noise encoding based on extracted background noise characteristic parameters of a current superframe, background noise characteristic parameters of a plurality of superframes previous to the current superframe, and a final DTX decision;

wherein the process of, for the first superframe after the hangover period, performing background noise encoding based on the extracted background noise characteristic parameters within the hangover period and the background noise characteristic parameters of the first superframe comprises:

within a first frame and a second frame of the first superframe after the hangover period, storing an autocorrelation coefficient of the corresponding first frame and second frame of the first superframe after the hangover period; and within the second frame of the first superframe after the hangover period, extracting an LPC filter coefficient and a residual energy $E_t$ of the first superframe based on the autocorrelation coefficients of the first frame and second frame and the extracted background noise characteristic parameters within the hangover period, and performing background noise encoding.

2. The method according to claim 1, wherein the process of extracting the background noise characteristic parameters within the hangover period comprises:

for each frame of a superframe within the hangover period, obtaining an autocorrelation coefficient of the each frame of the superframe within the hangover period.

3. The method according to claim 1, wherein:

the process of extracting the LPC filter coefficient and a residual energy $E_t$ comprises calculating the average of the autocorrelation coefficients of the first superframe and four superframes which are previous to the first superframe and within the hangover period, and calculating the LPC filter coefficient and the residual energy from the average of the autocorrelation coefficients based on a Levinson-Durbin algorithm; and the process of performing background noise encoding within the second frame further comprises transforming the LPC filter coefficient into the LSF domain for quantization encoding; and performing linear quantization encoding on the residual energy in the logarithm domain.

4. The method according to claim 1, wherein the process of, for superframes after the first superframe, performing background noise characteristic parameter extraction for each frame in the superframes after the first superframe comprises:

calculating the stationary average autocorrelation coefficient of the current frame based on the values of the autocorrelation coefficients of four recent consecutive frames, the stationary average autocorrelation coefficients being the average of the autocorrelation coefficients of two frames having intermediate norm values of autocorrelation coefficients in the four recent consecutive frames; and calculating the LPC filter coefficient and the residual energy from the stationary average autocorrelation coefficient based on the Levinson-durbin algorithm.

5. The method according to claim 4, wherein after the residual energy is calculated, the method further comprises:

performing a long-term smoothing on the residual energy to obtain the energy estimate of the current frame, the smoothing algorithm being $$E_LT=\alpha E_LT+(1-\alpha)E_{t,k}, \text{ with } 0<\alpha<1,$$

wherein the smoothed energy estimate of the current frame is assigned as the residual energy for quantization, as follows $$E_{t,k}=E_LT,$$

where k=1, 2, representing the first frame and the second frame respectively.

6. The method according to claim 1, wherein the process of, for superframes after the first superframe, performing DTX decision for each frame in the superframes after the first superframe further comprises:

if the LPC filter coefficient of the current frame and the LPC filter coefficient of the previous SID superframe exceed a preset threshold or the energy estimate of the current frame is substantially different from the energy estimate of the previous SID superframe, setting a parameter change flag of the current frame to 1; and if the LPC filter coefficient of the current frame and the LPC filter coefficient of the previous SID superframe do not exceed the preset threshold or the energy estimate of the current frame is not substantially different from the energy estimate of the previous SID superframe, setting the parameter change flag of the current frame to 0.

7. The method according to claim 1, wherein the process of performing DTX decision for each frame in the superframes after the first superframe further comprises:

if a frame of the current superframe has a DTX decision of 1, the DTX decision for the Lower-band component of the current superframe represents 1.

8. The method according to claim 7, wherein if a final DTX decision of the current superframe represents 1, the process of for superframes after the first superframe, performing background noise encoding based on the extracted background noise characteristic parameters of a current superframe, background noise characteristic parameters of a plurality of superframes previous to the current superframe, and a final DTX decision comprises:

determining a smoothing factor for the current superframe, wherein if the DTX decision of the first frame of the current superframe represents zero and the DTX decision of the second frame represents 1, the smoothing factor is 0.1; otherwise, the smoothing factor is 0.5;

performing parameter smoothing for the first frame and second frame of the current superframe, the smoothed parameters being the characteristic parameters of the current superframe for performing background noise encoding, wherein the parameter smoothing comprises:

calculating the smoothed average $R^t(j)$ from the stationary average autocorrelation coefficient of the first frame and the stationary average autocorrelation coefficient of the second frame, as follows: $R^t(j)=\text{smooth_rate}R^{t,1}(j)\pm(1-\text{smooth_rate})R^{h2}(j)$, where smooth_rate is the smoothing factor, $R^{t,1}(j)$ is the stationary average autocorrelation coefficient of the first frame, and $R^{t,2}(j)$ is the stationary average autocorrelation coefficient of the second frame;

calculating an LPC filter coefficient from the smoothed average $R^t(j)$ based on the Levinson-durbin algorithm; and calculating the smoothed average $\bar{E}_t$ from the energy estimate of the first frame and the energy estimate of the second frame, as follows: $\bar{E}_t=\text{smooth_rate}\,\bar{E}_{t,1}+(1-\text{smooth_rate})\bar{E}_{t,2}$, where $\bar{E}_{t,1}$ is the energy estimate of the first frame and $\bar{E}_{t,2}$ is the energy estimate of the second frame.

9. The method according to claim 1, wherein the process of performing background noise encoding based on the extracted background noise characteristic parameters of the current superframe, background noise characteristic parameters of a plurality of superframes previous to the current superframe, and a final DTX decision comprises:

calculating the average of the autocorrelation coefficients of a plurality of superframes previous to the current superframe;

calculating the average LPC filter coefficient of the plurality of superframes previous to the current superframe based on the average of the autocorrelation coefficients of a plurality of superframes previous to the current superframe;

if the difference between the average LPC filter coefficient and the LPC filter coefficient of the current superframe is less than or equal to a preset value, transforming the average LPC filter coefficient to the LSF domain for quantization encoding;

if the difference between the average LPC filter coefficient and the LPC filter coefficient of the current superframe is more than the preset value, transforming the LPC filter coefficient of the current superframe to the LSF domain for quantization encoding; and performing linear quantization encoding on an energy parameter in the logarithm domain.

10. An encoding apparatus comprising:

a first extracting unit, configured to extract background noise characteristic parameters within a hangover period;

a second encoding unit configured to, for a first superframe after the hangover period, perform background noise encoding based on the extracted background noise characteristic parameters within the hangover period and background noise characteristic parameters of the first superframe;

a second extracting unit configured to, for superframes after the first superframe, perform background noise characteristic parameter extraction for each frame in the superframes after the first superframe;

a Discontinuous Transmission (DTX) decision unit configured to, for superframes after the first superframe, perform DTX decision for each frame in the superframes after the first superframe; and a third encoding unit configured to, for the superframes after the first superframe, perform background noise encoding based on extracted background noise characteristic parameters of a current superframe, background noise characteristic parameters of a plurality of superframes previous to the current superframe, and a final DTX decision;

wherein the second encoding unit comprises:

an extracting module configured to, within a first frame and a second frame of the first superframe after the hangover period, store an autocorrelation coefficient of the corresponding first frame and second frame of the first superframe after the hangover period; and an encoding module configured to, within the second frame of the first superframe after the hangover period, extract an LPC filter coefficient and a residual energy $E_t$ of the first superframe based on the autocorrelation coefficients of the first frame and second frame and the extracted background noise characteristic parameters within the hangover period, and perform background noise encoding.

11. The apparatus according to claim 10, wherein the first extracting unit further comprises:

a buffer module configured to, for each frame of a superframe within the hangover period, obtain an autocorrelation coefficient of the each frame of the superframe within the hangover period.

12. The apparatus according to claim 10, wherein the second encoding unit comprises:

an extracting module configured to, within a first frame and a second frame of the first superframe after the hangover period, store an autocorrelation coefficient of the corresponding first frame and second frame of the first superframe after the hangover period; and an encoding module configured to, within the second frame of the first superframe after the hangover period, extract an LPC filter coefficient and a residual energy $E_t$ of the first superframe based on the autocorrelation coefficients of the first frame and second frame and the extracted background noise characteristic parameters within the hangover period, and perform background noise encoding.

13. The apparatus according to claim 10, wherein the second extracting unit comprises:

a first calculating module configured to, calculate the stationary average autocorrelation coefficient of the current frame based on the values of the autocorrelation coefficients of four recent consecutive frames, the stationary average of the autocorrelation coefficients being the average of the autocorrelation coefficients of two frames having intermediate norm values of autocorrelation coefficients in the four recent consecutive frames; and a second calculating module configured to calculate the LPC filter coefficient and the residual energy from the stationary average autocorrelation coefficient based on the Levinson-Durbin algorithm.

14. The apparatus according to claim 13, wherein the second extracting unit further comprises:

a second residual energy smoothing module configured to perform a long-term smoothing on the residual energy to obtain the energy estimate of the current frame, the smoothing algorithm being: $E_LT=\alpha E_LT+(1-\alpha)E_{t,k}$, with $0<\alpha<1$, wherein the smoothed energy estimate of the current frame is assigned as the residual energy for quantization, as follows: $E_{t,k}=E_LT$, where k=1, 2, representing the first frame and the second frame respectively.

15. The apparatus according to claim 10, wherein the DTX decision unit comprises:

a threshold comparing module configured to, if the LPC filter coefficient of the current frame and the LPC filter coefficient of the previous SID superframe exceed a preset threshold, generate a decision command;

an energy comparing module configured to calculate the average of the residual energies of the current frame and three recent previous frames as the energy estimate of the current frame; quantize the average of the residual energies with a quantizer in the logarithmic domain, and if the difference between the decoded logarithmic energy and the decoded logarithmic energy of the previous SID superframe exceeds a preset value, generate a decision command; and a first decision module configured to set a parameter change flag of the current frame to 1 according to the decision command.

16. The apparatus according to claim 15, wherein the DTX decision unit further comprises:

a second decision unit configured to, if the DTX decision for a frame of the current superframe represents 1, the DTX decision for the Lower-band component of the current superframe represents 1;

wherein the third encoding unit comprises (a) a smoothing command module configured to, if a final DTX decision of the current superframe represents 1, generate a smoothing command;

(b) a smoothing factor determining module configured to, upon receipt of the smoothing command, determine a smoothing factor for the current superframe, wherein if the DTX decision of the first frame of the current superframe represents zero and the DTX decision of the second frame of the current superframe represents 1, the smoothing factor is 0.1, otherwise, the smoothing factor is 0.5; and (c) a parameter smoothing module configured to perform parameter smoothing for the first frame and second frame of the current superframe, and the smoothed parameters being the characteristic parameters of the current superframe for performing background noise encoding, wherein the parameter smoothing comprises (a) calculating the smoothed average $R^t(j)$ from the stationary average autocorrelation coefficient of the first frame and the stationary average autocorrelation coefficient of the second frame, as follows: $R^t(j)=smooth_rate R^{t,1}(j)+(1-smooth_rate)R^{t,2}(j)$, where smooth_rate is the smoothing factor, $R^{t,1}(j)$ is the stationary average autocorrelation coefficients of the first frame, and $R^{t,2}(j)$ is the stationary average autocorrelation coefficients of the second frame;

(b) calculating an LPC filter coefficient from the smoothed average $R^t(j)$ based on the Levinson-Durbin algorithm; and (c) calculating the smoothed average $\overline{E}_t$ from the energy estimate of the first frame and the energy estimate of the second frame, as follows:

$$\overline{E}_t=smooth_rate\overline{E}_{t,1}+(1-smooth_rate)\overline{E}_{t,2},$$

where $\overline{E}_{t,1}$ is the energy estimate of the first frame and $\overline{E}_{t,2}$ is the energy estimate of the second frame.

17. The apparatus according to claim 10, wherein the third encoding unit comprises:

a third calculating module configured to calculate the average LPC filter coefficient of the plurality of superframes previous to the current superframe, based on a calculated average of the autocorrelation coefficients of a plurality of superframes previous to the current superframe;

a first encoding module configured to, if the difference between the average LPC filter coefficient and the LPC filter coefficient of the current superframe is less than or equal to a preset value, transform the average LPC filter coefficient to the LSF domain for quantization encoding;

a second encoding module configured to, if the difference between the average LPC filter coefficient and the LPC filter coefficient of the current superframe is more than the preset value, transform the LPC filter coefficient of the current superframe to the LSF domain for quantization encoding; and a third encoding module configured to perform linear quantization encoding on an energy parameter in the logarithm domain.

18. An encoding method comprising:

extracting background noise characteristic parameters within a hangover period;

for a first superframe after the hangover period, performing background noise encoding based on the extracted background noise characteristic parameters within the hangover period and background noise characteristic parameters of the first superframe;

for superframes after the first superframe, performing background noise characteristic parameter extraction and Discontinuous Transmission (DTX) decision for each frame in the superframes after the first superframe; and for the superframes after the first superframe, performing background noise encoding based on extracted background noise characteristic parameters of a current superframe, background noise characteristic parameters of a plurality of superframes previous to the current superframe, and a final DTX decision;

wherein the process of, for superframes after the first superframe, performing background noise characteristic parameter extraction for each frame in the superframes after the first superframe comprises calculating the stationary average autocorrelation coefficient of the current frame based on the values of the autocorrelation coefficients of four recent consecutive frames, the stationary average autocorrelation coefficients being the average of the autocorrelation coefficients of two frames having intermediate norm values of autocorrelation coefficients in the four recent consecutive frames; and calculating the LPC filter coefficient and the residual energy from the stationary average autocorrelation coefficient based on the Levinson-durbin algorithm; and wherein, after the residual energy is calculated, the method further comprises performing a long-term smoothing on the residual energy to obtain the energy estimate of the current frame, the smoothing algorithm being $$E_LT=\alpha E_LT+(1-\alpha)E_{t,k}, \text{ with } 0<\alpha<1,$$

wherein the smoothed energy estimate of the current frame is assigned as the residual energy for quantization, as follows $$E_{t,k}=E_LT,$$

where k=1, 2, representing the first frame and the second frame respectively.

19. The method according to claim 18, wherein the process of extracting the background noise characteristic parameters within the hangover period comprises:

for each frame of a superframe within the hangover period, obtaining an autocorrelation coefficient of the each frame of the superframe within the hangover period.

20. The method according to claim 18, wherein the process of, for superframes after the first superframe, performing DTX decision for each frame in the superframes after the first superframe further comprises:

if the LPC filter coefficient of the current frame and the LPC filter coefficient of the previous SID superframe exceed a preset threshold or the energy estimate of the current frame is substantially different from the energy estimate of the previous SID superframe, setting a parameter change flag of the current frame to 1; and if the LPC filter coefficient of the current frame and the LPC filter coefficient of the previous SID superframe do not exceed the preset threshold or the energy estimate of the current frame is not substantially different from the energy estimate of the previous SID superframe, setting the parameter change flag of the current frame to 0.

21. The method according to claim 18, wherein the process of performing background noise encoding based on the extracted background noise characteristic parameters of the current superframe, background noise characteristic parameters of a plurality of superframes previous to the current superframe, and a final DTX decision comprises:

calculating the average of the autocorrelation coefficients of a plurality of superframes previous to the current superframe;

calculating the average LPC filter coefficient of the plurality of superframes previous to the current superframe based on the average of the autocorrelation coefficients of a plurality of superframes previous to the current superframe;

if the difference between the average LPC filter coefficient and the LPC filter coefficient of the current superframe is less than or equal to a preset value, transforming the average LPC filter coefficient to the LSF domain for quantization encoding;

if the difference between the average LPC filter coefficient and the LPC filter coefficient of the current superframe is more than the preset value, transforming the LPC filter coefficient of the current superframe to the LSF domain for quantization encoding; and performing linear quantization encoding on an energy parameter in the logarithm domain.

22. An encoding method comprising:

extracting background noise characteristic parameters within a hangover period;

for a first superframe after the hangover period, performing background noise encoding based on the extracted background noise characteristic parameters within the hangover period and background noise characteristic parameters of the first superframe;

for superframes after the first superframe, performing background noise characteristic parameter extraction and Discontinuous Transmission (DTX) decision for each frame in the superframes after the first superframe; and for the superframes after the first superframe, performing background noise encoding based on extracted background noise characteristic parameters of a current superframe, background noise characteristic parameters of a plurality of superframes previous to the current superframe, and a final DTX decision;

wherein the process of performing DTX decision for each frame in the superframes after the first superframe further comprises, if a frame of the current superframe has a DTX decision of 1, the DTX decision for the Lower-band component of the current superframe represents 1; and wherein, if a final DTX decision of the current superframe represents 1, the process of for superframes after the first superframe, performing background noise encoding based on the extracted background noise characteristic parameters of a current superframe, background noise characteristic parameters of a plurality of superframes previous to the current superframe, and a final DTX decision comprises:

determining a smoothing factor for the current superframe, wherein if the DTX decision of the first frame of the current superframe represents zero and the DTX decision of the second frame represents 1, the smoothing factor is 0.1; otherwise, the smoothing factor is 0.5;

performing parameter smoothing for the first frame and second frame of the current superframe, the smoothed parameters being the characteristic parameters of the current superframe for performing background noise encoding, wherein the parameter smoothing comprises:

calculating the smoothed average $R^t(j)$ from the stationary average autocorrelation coefficient of the first frame and the stationary average autocorrelation coefficient of the second frame, as follows:

$$R^t(j)=\text{smooth_rate}R^{t,1}(j)+(1-\text{smooth_rate})R^{t,2}(j),$$

where smooth_rate is the smoothing factor, $R^{t,1}(j)$ is the stationary average autocorrelation coefficient of the first frame, and $R^{t,2}(j)$ is the stationary average autocorrelation coefficient of the second frame;

calculating an LPC filter coefficient from the smoothed average $R^t(j)$ based on the Levinson-durbin algorithm; and calculating the smoothed average $\overline{E}_t$ from the energy estimate of the first frame and the energy estimate of the second frame, as follows:

$$\overline{E}_t=\text{smooth_rate}\overline{E}_{t,1}+(1-\text{smooth_rate})\overline{E}_{t,2},$$

where $\overline{E}_{t,1}$ is the energy estimate of the first frame and $\overline{E}_{t,2}$ is the energy estimate of the second frame.

23. The method according to claim 22, wherein the process of extracting the background noise characteristic parameters within the hangover period comprises:

for each frame of a superframe within the hangover period, obtaining an autocorrelation coefficient of the each frame of the superframe within the hangover period.

24. The method according to claim 22, wherein the process of, for superframes after the first superframe, performing DTX decision for each frame in the superframes after the first superframe further comprises:

if the LPC filter coefficient of the current frame and the LPC filter coefficient of the previous SID superframe exceed a preset threshold or the energy estimate of the current frame is substantially different from the energy estimate of the previous SID superframe, setting a parameter change flag of the current frame to 1; and if the LPC filter coefficient of the current frame and the LPC filter coefficient of the previous SID superframe do not exceed the preset threshold or the energy estimate of the current frame is not substantially different from the energy estimate of the previous SID superframe, setting the parameter change flag of the current frame to 0.

* * * * *